US011272309B2

(12) United States Patent
Herre et al.

(10) Patent No.: US 11,272,309 B2
(45) **Date of Patent: *Mar. 8, 2022**

(54) APPARATUS AND METHOD FOR MAPPING FIRST AND SECOND INPUT CHANNELS TO AT LEAST ONE OUTPUT CHANNEL

(71) Applicant: Fraunhofer-Gesellschaft zur Foerderung der angewandten Forschung e.V., Munich (DE)

(72) Inventors: Juergen Herre, Erlangen (DE); Fabian Kuech, Erlangen (DE); Michael Kratschmer, Fuerth (DE); Achim Kuntz, Hemhofen (DE); Christof Faller, Greifensee (CH)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/912,228

(22) Filed: Jun. 25, 2020

(65) Prior Publication Data

US 2020/0396557 A1 Dec. 17, 2020

Related U.S. Application Data

(63) Continuation of application No. 16/178,228, filed on Nov. 1, 2018, now Pat. No. 10,701,507, which is a (Continued)

(30) Foreign Application Priority Data

Jul. 22, 2013 (EP) ..... 13177360
Oct. 18, 2013 (EP) ..... 13189243

(51) Int. Cl.

| | |
|---|---|
| ***H04S 7/00*** | (2006.01) |
| ***H04S 3/00*** | (2006.01) |
| ***H04S 3/02*** | (2006.01) |
| ***H04R 5/02*** | (2006.01) |

(Continued)

(52) U.S. Cl.
CPC ..... *H04S 7/303* (2013.01); *H04R 5/02* (2013.01); *H04S 3/002* (2013.01); *H04S 3/02* (2013.01);
(Continued)

(58) Field of Classification Search
CPC ..... H04S 2400/00; H04S 2400/01; H04S 2400/03; H04S 2400/05; H04S 2420/03;
(Continued)

(56) References Cited

U.S. PATENT DOCUMENTS 4,308,423 A 12/1981 Cohen
4,841,573 A 6/1989 Fujita
(Continued)

FOREIGN PATENT DOCUMENTS

AU 2013206557 A1 7/2013
CA 2494454 A1 3/2004
(Continued)

OTHER PUBLICATIONS

"Universal Mobile Telecommunications System (UMTS); Mandatory Speech Codec speech processing functions AMR Wideband speech codec; Transcoding functions", ETSI TS 126 190 V5.1.0 (Dec. 2001); 3GPP TS 26.190 version 5.1.0 Release 5;Universal Mobile Telecommunications System (UMTS); Mandatory Speech Codec speech processing functions AMR Wideband speech codec; Transcoding functions (3GPP TS 26.190 version 5.1.0 Release 5), Dec. 2001, 55 pp.
(Continued)

*Primary Examiner* — Leshui Zhang
(74) *Attorney, Agent, or Firm* — Perkins Coie LLP; Michael A. Glenn

(57) ABSTRACT

An apparatus for mapping a first input channel and a second input channel of an input channel configuration to at least one output channel of an output channel configuration,
(Continued)

wherein each input channel and each output channel has a direction in which an associated loudspeaker is located relative to a central listener position, configured to map the first input channel to a first output channel of the output channel configuration; and despite of the fact that an angle deviation between a direction of the second input channel and a direction of the first output channel is less than an angle deviation between a direction of the second input channel and the second output channel and/or is less than an angle deviation between the direction of the second input channel and the direction of the third output channel, map the second input channel to the second and third output channels by panning between the second and third output channels.

17 Claims, 10 Drawing Sheets

Related U.S. Application Data continuation of application No. 15/002,094, filed on Jan. 20, 2016, now Pat. No. 10,154,362, which is a continuation of application No. PCT/EP2014/065153, filed on Jul. 15, 2014.

(51) Int. Cl.
*G10L 19/008* (2013.01)
*G10L 19/00* (2013.01)

(52) U.S. Cl.
CPC ..... *H04S 7/30* (2013.01); *H04S 7/302* (2013.01); *H04S 7/308* (2013.01); *G10L 19/008* (2013.01); *H04S 7/305* (2013.01); *H04S 2400/01* (2013.01); *H04S 2400/03* (2013.01); *H04S 2420/03* (2013.01)

(58) Field of Classification Search
CPC . H04S 7/00; H04S 7/303; H04S 7/308; H04S 7/30; H04S 7/302; H04S 7/305; H04S 3/02; H04S 3/002; H04S 3/004; H04S 3/008; H04R 5/00; H04R 5/02; G10L 19/00; G10L 19/008
USPC ..... 381/1–23, 300–311, 26, 27, 119, 123, 381/77–85, 86; 700/94
See application file for complete search history.

(56) References Cited

U.S. PATENT DOCUMENTS

| | | | |
|---|---|---|---|
| 6,128,597 | A | 10/2000 | Kolluru et al. |
| 6,421,446 | B1 | 7/2002 | Cashion et al. |
| 8,050,434 | B1 | 11/2011 | Kato et al. |
| 8,086,331 | B2 | 12/2011 | Ikeda et al. |
| 8,306,233 | B2 | 11/2012 | Sinton et al. |
| 8,526,484 | B2 | 9/2013 | Sato |
| 8,638,959 | B1 | 1/2014 | Hall |
| 2002/0006081 | A1 | 1/2002 | Fujishita |
| 2004/0062401 | A1 | 4/2004 | Davis |
| 2005/0157883 | A1 | 7/2005 | Herre et al. |
| 2005/0276420 | A1 | 12/2005 | Davis |
| 2006/0072764 | A1 | 4/2006 | Mertens et al. |
| 2007/0011004 | A1 | 1/2007 | Liebchen |
| 2007/0019812 | A1 | 1/2007 | Kim |
| 2007/0080485 | A1 | 4/2007 | Kerscher et al. |
| 2007/0255572 | A1 | 11/2007 | Miyasaka et al. |
| 2007/0280485 | A1 | 12/2007 | Villemoes |
| 2008/0221907 | A1 | 9/2008 | Pang et al. |
| 2008/0279389 | A1 | 11/2008 | Yoo et al. |
| 2008/0298610 | A1 | 12/2008 | Virolainen et al. |
| 2009/0092259 | A1 | 4/2009 | Jot et al. |
| 2009/0292544 | A1 | 11/2009 | Virette et al. |
| 2010/0014692 | A1 | 1/2010 | Schreiner et al. |
| 2010/0260483 | A1 | 10/2010 | Strub |
| 2011/0013790 | A1 | 1/2011 | Hilpert et al. |
| 2011/0103590 | A1* | 5/2011 | Christoph ..... H04S 7/302 381/17 |
| 2011/0135098 | A1* | 6/2011 | Kuhr ..... H04S 7/304 381/17 |
| 2011/0200197 | A1 | 8/2011 | Kim et al. |
| 2011/0222693 | A1 | 9/2011 | Lee et al. |
| 2011/0249819 | A1 | 10/2011 | Davis |
| 2011/0255714 | A1 | 10/2011 | Neusinger et al. |
| 2011/0255715 | A1 | 10/2011 | Doh et al. |
| 2012/0051565 | A1 | 3/2012 | Iwata et al. |
| 2012/0093322 | A1 | 4/2012 | Lee |
| 2012/0093323 | A1* | 4/2012 | Lee ..... H04S 3/00 381/23 |
| 2012/0177204 | A1 | 7/2012 | Hellmuth et al. |
| 2012/0209615 | A1 | 8/2012 | Thesing et al. |
| 2012/0213375 | A1 | 8/2012 | Mahabub et al. |
| 2012/0263307 | A1 | 10/2012 | Armstrong et al. |
| 2012/0288124 | A1 | 11/2012 | Fejzo et al. |
| 2013/0182853 | A1 | 7/2013 | Chang et al. |
| 2013/0216070 | A1 | 8/2013 | Keiler et al. |
| 2013/0259236 | A1 | 10/2013 | Chon et al. |
| 2013/0272525 | A1 | 10/2013 | Yoo et al. |
| 2014/0093101 | A1 | 4/2014 | Lee et al. |
| 2014/0133683 | A1 | 5/2014 | Robinson et al. |
| 2014/0233762 | A1 | 8/2014 | Vilkamo et al. |
| 2015/0350804 | A1 | 12/2015 | Crockett et al. |

FOREIGN PATENT DOCUMENTS

| | | | | |
|---|---|---|---|---|
| CN | 1714598 | A | 12/2005 | |
| CN | 101010726 | A | 8/2007 | |
| CN | 101460997 | A | 6/2009 | |
| CN | 101669167 | A | 3/2010 | |
| CN | 102273233 | A | 12/2011 | |
| CN | 102547551 | A | 7/2012 | |
| CN | 102656627 | A | 9/2012 | |
| CN | 103210668 | A | 7/2013 | |
| EP | 2434491 | A1 | 3/2012 | |
| JP | 06128724 | A | 5/1994 | |
| JP | 08009499 | B2 | 1/1996 | |
| JP | 2003331532 | A | 11/2003 | |
| JP | 2005535266 | A | 11/2005 | |
| JP | 2009077379 | A | 4/2009 | |
| JP | 2009100144 | A * | 5/2009 | ..... H04S 5/02 |
| KR | 20110102660 | A | 9/2011 | |
| KR | 1020120038891 | A | 4/2012 | |
| RU | 2329548 | C2 | 7/2008 | |
| RU | 2330390 | C2 | 7/2008 | |
| RU | 2008140140 | A | 4/2010 | |
| RU | 2394283 | C1 | 7/2010 | |
| RU | 2406166 | C2 | 12/2010 | |
| RU | 2449388 | C2 | 4/2012 | |
| TW | 200803190 | A | 1/2008 | |
| TW | 200939208 | A | 9/2009 | |
| TW | 201034005 | A | 9/2010 | |
| TW | 201108204 | A | 3/2011 | |
| TW | I342718 | B | 5/2011 | |
| TW | 201320059 | A | 5/2013 | |
| TW | 201329959 | A | 7/2013 | |
| WO | 8706090 | A1 | 10/1987 | |
| WO | 2009046460 | A2 | 4/2009 | |
| WO | 2010006719 | A1 | 1/2010 | |
| WO | 2010012478 | A2 | 2/2010 | |
| WO | 2011152044 | A1 | 12/2011 | |
| WO | 2012109019 | A1 | 8/2012 | |
| WO | 2012154823 | A1 | 11/2012 | |
| WO | 2013006338 | A2 | 1/2013 | |
| WO | 2014015299 | A1 | 1/2014 | |
| WO | 2014041067 | A1 | 3/2014 | |

OTHER PUBLICATIONS

Ando, Akio, "Conversion of Multichannel Sound Signal Maintaining Physical Properties of Sound in Reproduced Sound Field", IEEE Transactions on Audio, Speech, and Language Processing, vol. 19, No. 6, pp. 1467-1474.

(56) References Cited

OTHER PUBLICATIONS

Blauert, Jens, "Ein Neuartiges Prasenfilter", Fernseh- und KinotechnikNr. 3. Retrieved from the Internet: URL:http://www.sengpielaudio.com/Blauert-Filter.pdf, pp. 75-78.
Pulkki, Ville, "Virtual Sound Source Positioning Using Vector Base Amplitude Panning", Journal of Audio Eng. Soc. vol. 45, No. 6., pp. 456-466.

* cited by examiner

APPARATUS AND METHOD FOR MAPPING FIRST AND SECOND INPUT CHANNELS TO AT LEAST ONE OUTPUT CHANNEL

CROSS-REFERENCE TO RELATED APPLICATIONS

This application is a continuation of copending U.S. patent application Ser. No. 16/178,228 filed Nov. 1, 2018, which is a continuation of U.S. patent application Ser. No. 15/002,094, filed Jan. 20, 2016 (U.S. Pat. No. 10,154,362 issued Dec. 11, 2018), which in turn is a continuation of copending International Application No. PCT/EP2014/065153, filed Jul. 15, 2014, which are both incorporated herein by reference in their entirety, and additionally claims priority from European Application No. 13177360.8, filed Jul. 22, 2013, and from European Application No. 13189243.2, filed Oct. 18, 2013, which are also incorporated herein by reference in their entirety.

BACKGROUND OF THE INVENTION

The present application is related to an apparatus and a method for mapping first and second input channels to at least one output channel and, in particular, an apparatus and a method suitable to be used in a format conversion between different loudspeaker channel configurations.

Spatial audio coding tools are well-known in the art and are standardized, for example, in the MPEG-surround standard. Spatial audio coding starts from a plurality of original input, e.g., five or seven input channels, which are identified by their placement in a reproduction setup, e.g., as a left channel, a center channel, a right channel, a left surround channel, a right surround channel and a low frequency enhancement (LFE) channel. A spatial audio encoder may derive one or more downmix channels from the original channels and, additionally, may derive parametric data relating to spatial cues such as interchannel level differences in the channel coherence values, interchannel phase differences, interchannel time differences, etc. The one or more downmix channels are transmitted together with the parametric side information indicating the spatial cues to a spatial audio decoder for decoding the downmix channels and the associated parametric data in order to finally obtain output channels which are an approximated version of the original input channels. The placement of the channels in the output setup may be fixed, e.g., a 5.1 format, a 7.1 format, etc.

Also, spatial audio object coding tools are well-known in the art and are standardized, for example, in the MPEG SAOC standard (SAOC=spatial audio object coding). In contrast to spatial audio coding starting from original channels, spatial audio object coding starts from audio objects which are not automatically dedicated for a certain rendering reproduction setup. Rather, the placement of the audio objects in the reproduction scene is flexible and may be set by a user, e.g., by inputting certain rendering information into a spatial audio object coding decoder. Alternatively or additionally, rendering information may be transmitted as additional side information or metadata; rendering information may include information at which position in the reproduction setup a certain audio object is to be placed (e.g. over time). In order to obtain a certain data compression, a number of audio objects is encoded using an SAOC encoder which calculates, from the input objects, one or more transport channels by downmixing the objects in accordance with certain downmixing information. Furthermore, the SAOC encoder calculates parametric side information representing inter-object cues such as object level differences (OLD), object coherence values, etc. As in SAC (SAC=Spatial Audio Coding), the inter object parametric data is calculated for individual time/frequency tiles. For a certain frame (for example, 1024 or 2048 samples) of the audio signal a plurality of frequency bands (for example 24, 32, or 64 bands) are considered so that parametric data is provided for each frame and each frequency band. For example, when an audio piece has 20 frames and when each frame is subdivided into 32 frequency bands, the number of time/frequency tiles is 640.

A desired reproduction format, i.e. an output channel configuration (output loudspeaker configuration) may differ from an input channel configuration, wherein the number of output channels is generally different from the number of input channels. Thus, a format conversion may be necessitated to map the input channels of the input channel configuration to the output channels of the output channel configuration.

It is the object underlying the invention to provide for an apparatus and a method which permit an improved sound reproduction, in particular in case of a format conversion between different loudspeaker channel configurations.

SUMMARY

An embodiment may have an apparatus for mapping a first input channel and a second input channel of an input channel configuration to at least one output channel of an output channel configuration, wherein each input channel and each output channel has a direction in which an associated loudspeaker is located relative to a central listener position, wherein the apparatus is configured to: map the first input channel to a first output channel of the output channel configuration; and at least one of a) map the second input channel to the first output channel, including processing the second input channel by applying at least one of an equalization filter and a decorrelation filter to the second input channel; and b) despite of the fact that an angle deviation between a direction of the second input channel and a direction of the first output channel is less than an angle deviation between a direction of the second input channel and the second output channel and/or is less than an angle deviation between the direction of the second input channel and the direction of the third output channel, map the second input channel to the second and third output channels by panning between the second and third output channels.

According to another embodiment, a method for mapping a first input channel and a second input channel of an input channel configuration to at least one output channel of an output channel configuration, wherein each input channel and each output channel has a direction in which an associated loudspeaker is located relative to a central listener position, may have the steps of: mapping the first input channel to a first output channel of the output channel configuration; and at least one of a) mapping the second input channel to the first output channel, including processing the second input channel by applying at least one of an equalization filter and a decorrelation filter to the second input channel; and b) despite of the fact that an angle deviation between a direction of the second input channel and a direction of the first output channel is less than an angle deviation between a direction of the second input channel and the second output channel and/or is less than an angle deviation between the direction of the second input channel and the direction of the third output channel, mapping the second input channel to the second and third output channels by panning between the second and third output channels.

Another embodiment may have a non-transitory digital storage medium having a computer program stored thereon to perform the inventive method when said computer program is run by a computer.

Embodiments of the invention provide for an apparatus for mapping a first input channel and a second input channel of an input channel configuration to at least one output channel of an output channel configuration, wherein each input channel and each output channel has a direction in which an associated loudspeaker is located relative to a central listener position, wherein the apparatus is configured to:

map the first input channel to a first output channel of the output channel configuration; and at least one of a) map the second input channel to the first output channel, comprising processing the second input channel by applying at least one of an equalization filter and a decorrelation filter to the second input channel; and b) despite of the fact that an angle deviation between a direction of the second input channel and a direction of the first output channel is less than an angle deviation between a direction of the second input channel and the second output channel and/or is less than an angle deviation between the direction of the second input channel and the direction of the third output channel, map the second input channel to the second and third output channels by panning between the second and third output channels.

Embodiments of the invention provide for a method for mapping a first input channel and a second input channel of an input channel configuration to at least one output channel of an output channel configuration, wherein each input channel and each output channel has a direction in which an associated loudspeaker is located relative to a central listener position, comprising:

mapping the first input channel to a first output channel of the output channel configuration; and at least one of a) mapping the second input channel to the first output channel, comprising processing the second input channel by applying at least one of an equalization filter and a decorrelation filter to the second input channel; and b) despite of the fact that an angle deviation between a direction of the second input channel and a direction of the first output channel is less than an angle deviation between a direction of the second input channel and the second output channel and/or is less than an angle deviation between the direction of the second input channel and the direction of the third output channel, mapping the second input channel to the second and third output channels by panning between the second and third output channels.

Embodiments of the invention are based on the finding that an improved audio reproduction can be achieved even in case of a downmixing process from a number of input channels to a smaller number of output channels if an approach is used which is designed to attempt to preserve the spatial diversity of at least two input channels which are mapped to at least one output channel. According to embodiments of the invention, this is achieved by processing one of the input channels mapped to the same output channel by applying at least one of an equalization filter and a decorrelation filter. In embodiments of the invention, this is achieved by generating a phantom source for one of the input channels using two output channels, at least one of which has an angle deviation from the input channel which is larger than an angle deviation from the input channel to another output channel.

In embodiments of the invention, an equalization filter is applied to the second input channel and is configured to boost a spectral portion of the second input channel, which is known to give the listener the impression that sound comes from a position corresponding to the position of the second input channel. In embodiments of the invention, an elevation angle of the second input channel may be larger than an elevation angle of the one or more output channels the input channel is mapped to. For example, a loudspeaker associated with the second input channel may be at a position above a horizontal listener plane, while loudspeakers associated with the one or more output channels may be at a position in the horizontal listener plane. The equalization filter may be configured to boost a spectral portion of the second channel in a frequency range between 7 kHz and 10 kHz. By processing the second input signal in this manner, a listener may be given the impression that the sound comes from an elevated position even if it actually does not come from an elevated position.

In embodiments of the invention, the second input channel is processed by applying an equalization filter configured to process the second input channel in order to compensate for timbre differences caused by different positions of the second input channel and the at least one output channel which the second input channel is mapped to. Thus, the timbre of the second input channel, which is reproduced by a loudspeaker at a wrong position may be manipulated so that a user may get the impression that the sound stems from another position closer to the original position, i.e. the position of the second input channel.

In embodiments of the invention, a decorrelation filter is applied to the second input channel. Applying a decorrelation filter to the second input channel may also give a listener the impression that sound signals reproduced by the first output channel stem from different input channels located at different positions in the input channel configuration. For example, the decorrelation filter may be configured to introduce frequency dependent delays and/or randomized phases into the second input channel. In embodiments of the invention, the decorrelation filter may be a reverberation filter configured to introduce reverberation signal portions into the second input channel, so that a listener may get the impression that the sound signals reproduced via the first output channel stem from different positions. In embodiments of the invention, the decorrelation filter may be configured to convolve the second input channel with an exponentially decaying noise sequence in order to simulate diffuse reflections in the second input signal.

In embodiments of the invention, coefficients of the equalization filter and/or the decorrelation filter are set based on a measured binaural room impulse response (BRIR) of a specific listening room or are set based on empirical knowledge about room acoustics (which may also take into consideration a specific listening room). Thus, the respective processing in order to take spatial diversity of the input channels into consideration may be adapted through the specific scenery, such as the specific listening room, in which the signal is to be reproduced by means of the output channel configuration.

BRIEF DESCRIPTION OF THE DRAWINGS

Embodiments of the invention will be detailed below referring to the accompanying figures, in which.

DETAILED DESCRIPTION OF THE INVENTION

Before describing embodiments of the inventive approach in detail, an overview of a 3D audio codec system in which the inventive approach may be implemented is given.

Figure 1:
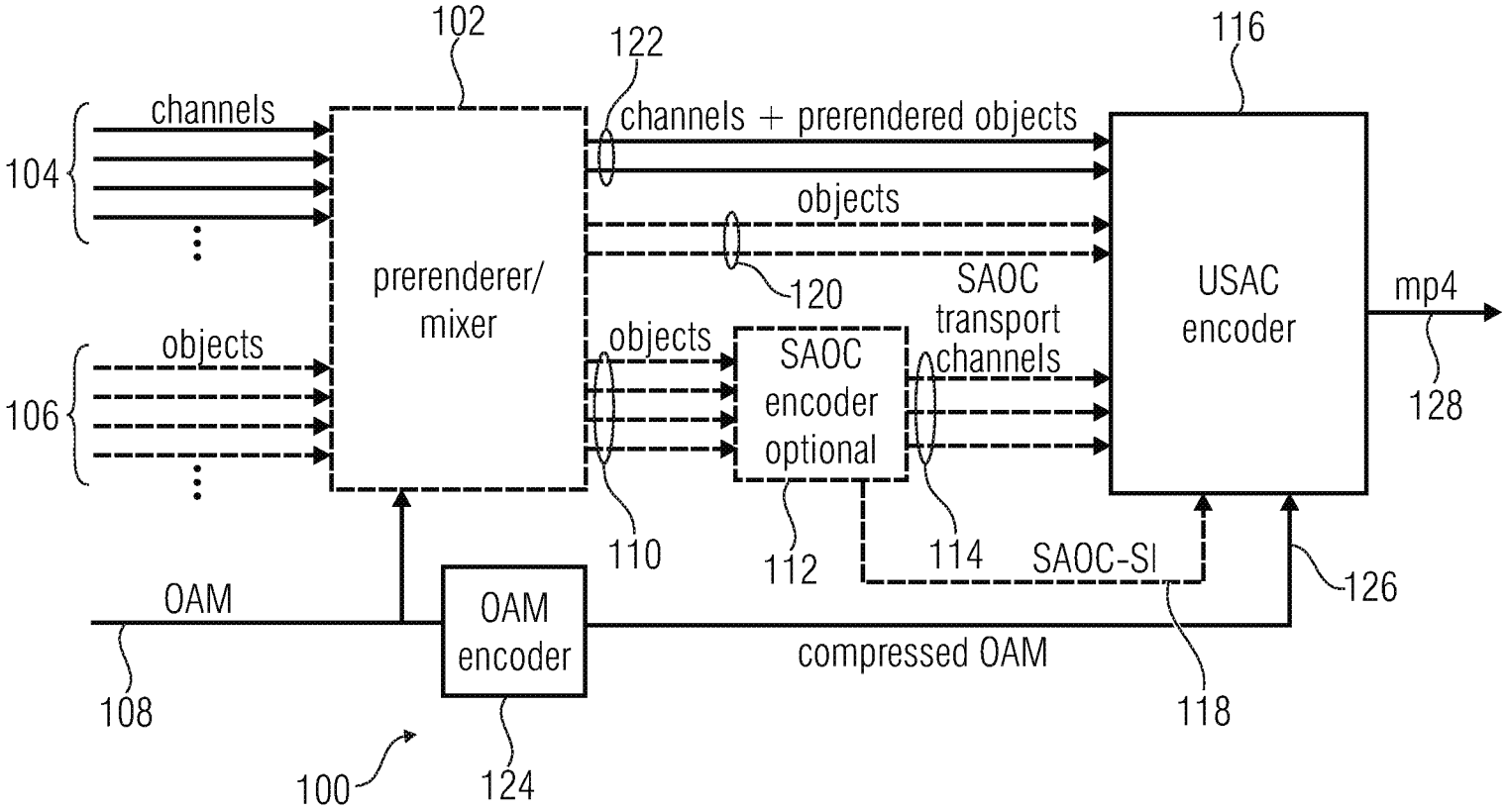
FIG. 1 shows an overview of a 3D audio encoder of a 3D audio system.
Figure 2:
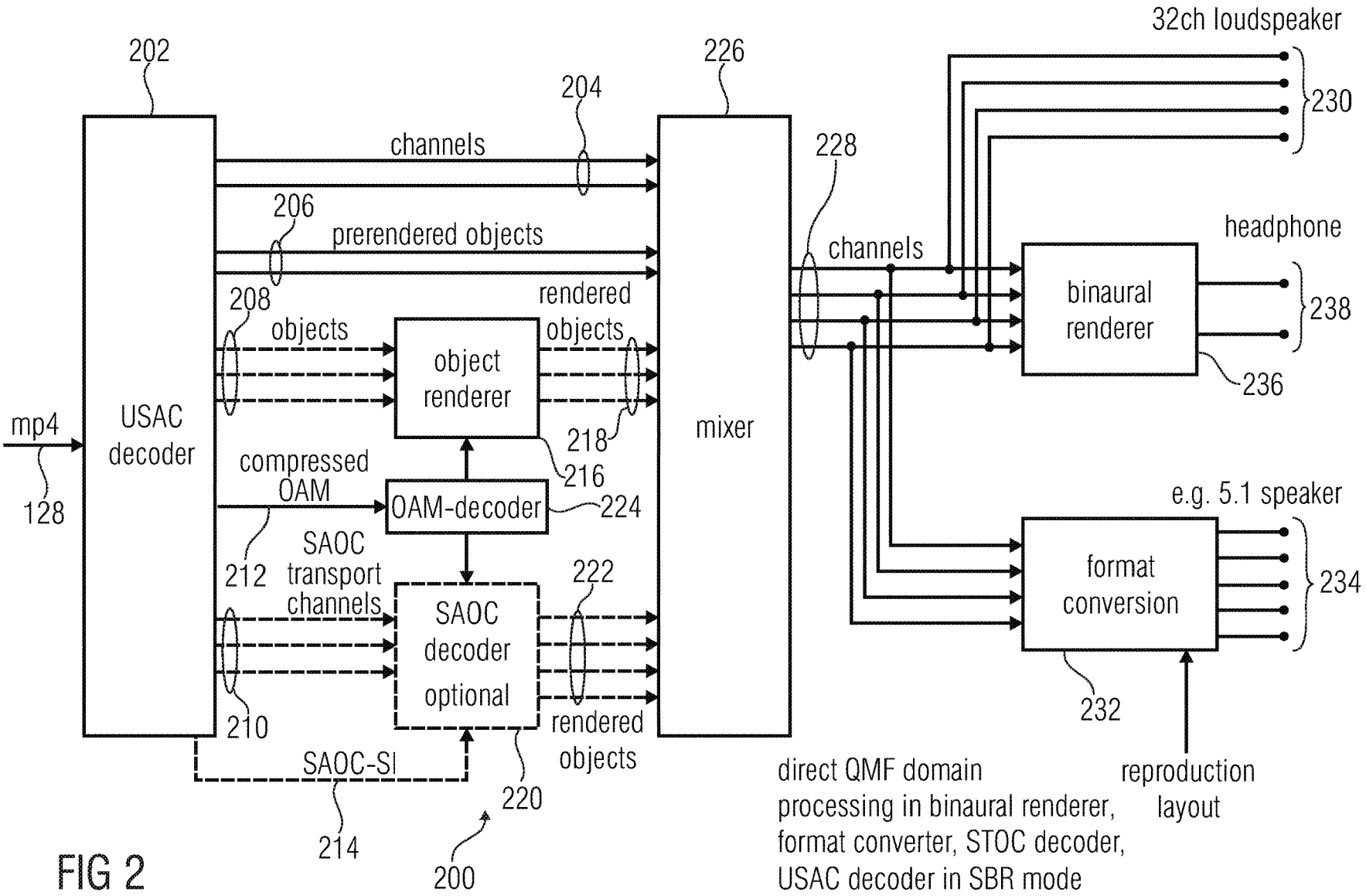
FIG. 2 shows an overview of a 3D audio decoder of a 3D audio system.

FIGS. 1 and 2 show the algorithmic blocks of a 3D audio system in accordance with embodiments. More specifically, FIG. 1 shows an overview of a 3D audio encoder 100. The audio encoder 100 receives at a pre-renderer/mixer circuit 102, which may be optionally provided, input signals, more specifically a plurality of input channels providing to the audio encoder 100 a plurality of channel signals 104, a plurality of object signals 106 and corresponding object metadata 108. The object signals 106 processed are by the pre-renderer/mixer 102 (see signals 110) may be provided to a SAOC encoder 112 (SAOC=Spatial Audio Object Coding). The SAOC encoder 112 generates the SAOC transport channels 114 provided to the inputs of an USAC encoder 116 (USAC=Unified Speech and Audio Coding). In addition, the signal SAOC-SI 118 (SAOC-SI=SAOC side information) is also provided to the inputs of the USAC encoder 116. The USAC encoder 116 further receives object signals 120 directly from the pre-renderer/mixer as well as the channel signals and pre-rendered object signals 122. The object metadata information 108 is applied to a OAM encoder 124 (OAM=object metadata) providing the compressed object metadata information 126 to the USAC encoder. The USAC encoder 116, on the basis of the above mentioned input signals, generates a compressed output signal MP4, as is shown at 128.

FIG. 2 shows an overview of a 3D audio decoder 200 of the 3D audio system. The encoded signal 128 (MP4) generated by the audio encoder 100 of FIG. 1 is received at the audio decoder 200, more specifically at an USAC decoder 202. The USAC decoder 202 decodes the received signal 128 into the channel signals 204, the pre-rendered object signals 206, the object signals 208, and the SAOC transport channel signals 210. Further, the compressed object metadata information 212 and the signal SAOC-SI 214 is output by the USAC decoder. The object signals 208 are provided to an object renderer 216 outputting the rendered object signals 218. The SAOC transport channel signals 210 are supplied to the SAOC decoder 220 outputting the rendered object signals 222. The compressed object meta information 212 is supplied to the OAM decoder 224 outputting respective control signals to the object renderer 216 and the SAOC decoder 220 for generating the rendered object signals 218 and the rendered object signals 222. The decoder further comprises a mixer 226 receiving, as shown in FIG. 2, the input signals 204, 206, 218 and 222 for outputting the channel signals 228. The channel signals can be directly output to a loudspeaker, e.g., a 32 channel loudspeaker, as is indicated at 230. Alternatively, the signals 228 may be provided to a format conversion circuit 232 receiving as a control input a reproduction layout signal indicating the way the channel signals 228 are to be converted. In the embodiment depicted in FIG. 2, it is assumed that the conversion is to be done in such a way that the signals can be provided to a 5.1 speaker system as is indicated at 234. Also, the channels signals 228 are provided to a binaural renderer 236 generating two output signals, for example for a headphone, as is indicated at 238.

The encoding/decoding system depicted in FIGS. 1 and 2 may be based on the MPEG-D USAC codec for coding of channel and object signals (see signals 104 and 106). To increase the efficiency for coding a large amount of objects, the MPEG SAOC technology may be used. Three types of renderers may perform the tasks of rendering objects to channels, rendering channels to headphones or rendering channels to a different loudspeaker setup (see FIG. 2, reference signs 230, 234 and 238). When object signals are explicitly transmitted or parametrically encoded using SAOC, the corresponding object metadata information 108 is compressed (see signal 126) and multiplexed into the 3D audio bitstream 128.

FIGS. 1 and 2 show the algorithm blocks for the overall 3D audio system which will be described in further detail below.

The pre-renderer/mixer 102 may be optionally provided to convert a channel plus object input scene into a channel scene before encoding. Functionally, it is identical to the object renderer/mixer that will be described in detail below. Pre-rendering of objects may be desired to ensure a deterministic signal entropy at the encoder input that is basically independent of the number of simultaneously active object signals. With pre-rendering of objects, no object metadata transmission is necessitated. Discrete object signals are rendered to the channel layout that the encoder is configured to use. The weights of the objects for each channel are obtained from the associated object metadata (OAM).

The USAC encoder 116 is the core codec for loudspeaker-channel signals, discrete object signals, object downmix signals and pre-rendered signals. It is based on the MPEG-D USAC technology. It handles the coding of the above signals by creating channel- and object mapping information based on the geometric and semantic information of the input channel and object assignment. This mapping information describes how input channels and objects are mapped to USAC-channel elements, like channel pair elements (CPEs), single channel elements (SCEs), low frequency effects (LFEs) and channel quad elements (QCEs) and CPEs, SCEs and LFEs, and the corresponding information is transmitted to the decoder. All additional payloads like SAOC data 114, 118 or object metadata 126 are considered in the encoders rate control. The coding of objects is possible in different ways, depending on the rate/distortion requirements and the interactivity requirements for the renderer. In accordance with embodiments, the following object coding variants are possible:

- Pre-rendered objects: Object signals are pre-rendered and mixed to the 22.2 channel signals before encoding. The subsequent coding chain sees 22.2 channel signals.
- Discrete object waveforms: Objects are supplied as monophonic waveforms to the encoder. The encoder uses single channel elements (SCEs) to transmit the objects in addition to the channel signals. The decoded objects are rendered and mixed at the receiver side. Compressed object metadata information is transmitted to the receiver/renderer.
- Parametric object waveforms: Object properties and their relation to each other are described by means of SAOC parameters. The down-mix of the object signals is coded with the USAC. The parametric information is transmitted alongside. The number of downmix channels is chosen depending on the number of objects and the overall data rate. Compressed object metadata information is transmitted to the SAOC renderer.

The SAOC encoder 112 and the SAOC decoder 220 for object signals may be based on the MPEG SAOC technology. The system is capable of recreating, modifying and rendering a number of audio objects based on a smaller number of transmitted channels and additional parametric data, such as OLDs, IOCs (Inter Object Coherence), DMGs (Down Mix Gains). The additional parametric data exhibits a significantly lower data rate than necessitated for transmitting all objects individually, making the coding very efficient. The SAOC encoder 112 takes as input the object/channel signals as monophonic waveforms and outputs the parametric information (which is packed into the 3D-Audio bitstream 128) and the SAOC transport channels (which are encoded using single channel elements and are transmitted). The SAOC decoder 220 reconstructs the object/channel signals from the decoded SAOC transport channels 210 and the parametric information 214, and generates the output audio scene based on the reproduction layout, the decompressed object metadata information and optionally on the basis of the user interaction information.

The object metadata codec (see OAM encoder 124 and OAM decoder 224) is provided so that, for each object, the associated metadata that specifies the geometrical position and volume of the objects in the 3D space is efficiently coded by quantization of the object properties in time and space. The compressed object metadata cOAM 126 is transmitted to the receiver 200 as side information.

The object renderer 216 utilizes the compressed object metadata to generate object waveforms according to the given reproduction format. Each object is rendered to a certain output channel 218 according to its metadata. The output of this block results from the sum of the partial results. If both channel based content as well as discrete/parametric objects are decoded, the channel based waveforms and the rendered object waveforms are mixed by the mixer 226 before outputting the resulting waveforms 228 or before feeding them to a postprocessor module like the binaural renderer 236 or the loudspeaker renderer module 232.

The binaural renderer module 236 produces a binaural downmix of the multichannel audio material such that each input channel is represented by a virtual sound source. The processing is conducted frame-wise in the QMF (Quadrature Mirror Filterbank) domain, and the binauralization is based on measured binaural room impulse responses.

The loudspeaker renderer 232 converts between the transmitted channel configuration 228 and the desired reproduction format. It may also be called "format converter". The format converter performs conversions to lower numbers of output channels, i.e., it creates downmixes.

Figure 3:
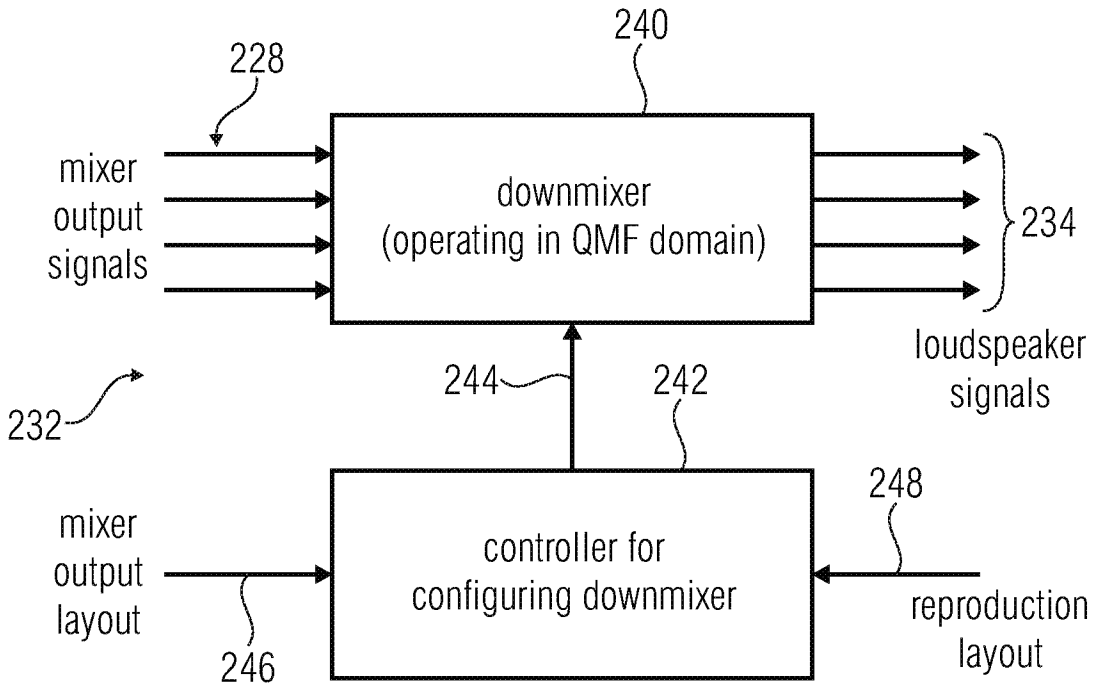
FIG. 3 shows an example for implementing a format converter that may be implemented in the 3D audio decoder of FIG. 2.

A possible implementation of a format converter 232 is shown in FIG. 3. In embodiments of the invention, the signal processing unit is such a format converter. The format converter 232, also referred to as loudspeaker renderer, converts between the transmitter channel configuration and the desired reproduction format by mapping the transmitter (input) channels of the transmitter (input) channel configuration to the (output) channels of the desired reproduction format (output channel configuration). The format converter 232 generally performs conversions to a lower number of output channels, i.e., it performs a downmix (DMX) process 240. The downmixer 240, which advantageously operates in the QMF domain, receives the mixer output signals 228 and outputs the loudspeaker signals 234. A configurator 242, also referred to as controller, may be provided which receives, as a control input, a signal 246 indicative of the mixer output layout (input channel configuration), i.e., the layout for which data represented by the mixer output signal 228 is determined, and the signal 248 indicative of the desired reproduction layout (output channel configuration). Based on this information, the controller 242, advantageously automatically, generates downmix matrices for the given combination of input and output formats and applies these matrices to the downmixer 240. The format converter 232 allows for standard loudspeaker configurations as well as for random configurations with non-standard loudspeaker positions.

Embodiments of the present invention relate to an implementation of the loudspeaker renderer 232, i.e. apparatus and methods for implementing part of the functionality of the loudspeaker renderer 232.

Figure 4:
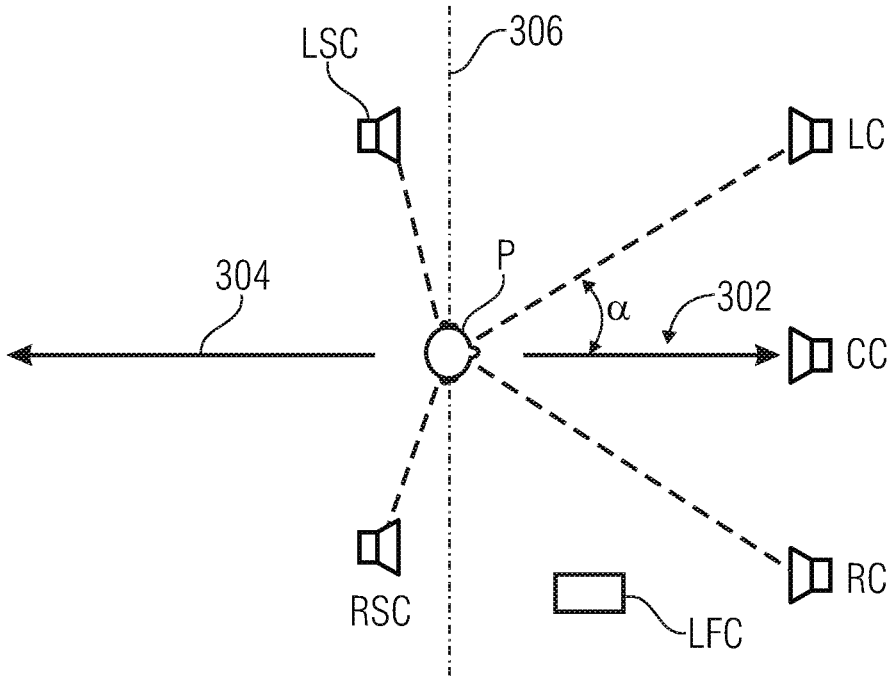
FIG. 4 shows a schematic top view of a loudspeaker configuration.
Figure 5:
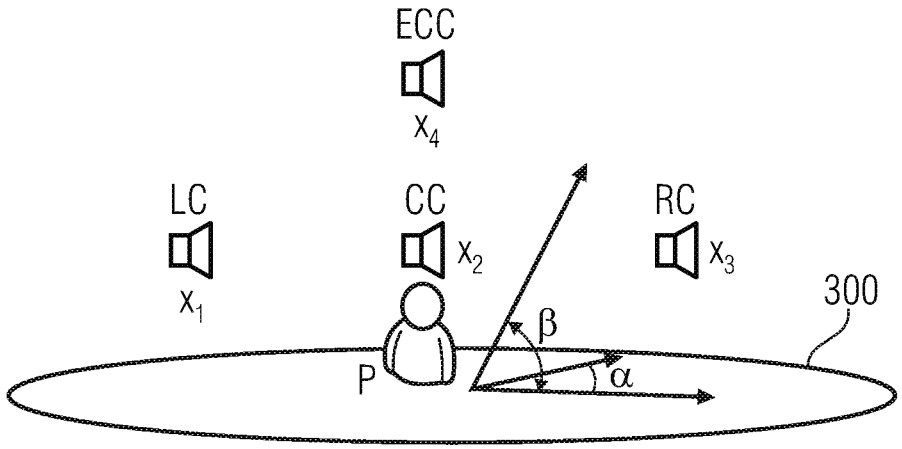
FIG. 5 shows a schematic back view of another loudspeaker configuration.

Reference is now made to FIGS. 4 and 5. FIG. 4 shows a loudspeaker configuration representing a 5.1 format comprising six loudspeakers representing a left channel LC, a center channel CC, a right channel RC, a left surround channel LSC, a right surround channel LRC and a low frequency enhancement channel LFC. FIG. 5 shows another loudspeaker configuration comprising loudspeakers representing a left channel LC, a center channel CC, a right channel RC and an elevated center channel ECC.

In the following, the low frequency enhancement channel is not considered since the exact position of the loudspeaker (subwoofer) associated with the low frequency enhancement channel is not important.

The channels are arranged at specific directions with respect to a central listener position P. The direction of each channel is defined by an azimuth angle $\alpha$ and an elevation angle $\beta$, see FIG. 5. The azimuth angle represents the angle of the channel in a horizontal listener plane 300 and may represent the direction of the respective channel with respect to a front center direction 302. As can be seen in FIG. 4, the front center direction 302 may be defined as the supposed viewing direction of a listener located at the central listener position P. A rear center direction 304 comprises an azimuth angle of 180° relative to the front center direction 300. All azimuth angles on the left of the front center direction between the front center direction and the rear center direction are on the left side of the front center direction and all azimuth angles on the right of the front center direction between the front center direction and the rear center direction are on the right side of the front center direction. Loudspeakers located in front of a virtual line 306, which is orthogonal to the front center direction 302 and passes the central listener position P, are front loudspeakers and loudspeakers located behind virtual line 306 are rear loudspeakers. In the 5.1 format, the azimuth angle $\alpha$ of channel LC is 30° to the left, a of CC is 0°, a of RC is 30° to the right, a of LSC is 110° to the left, and a of RSC is 110° to the right.

The elevation angle $\beta$ of a channel defines the angle between the horizontal listener plane 300 and the direction of a virtual connection line between the central listener position and the loudspeaker associated with the channel. In the configuration shown in FIG. 4, all loudspeakers are arranged within the horizontal listener plane 300 and, therefore, all elevation angles are zero. In FIG. 5, elevation angle $\beta$ of channel ECC may be 30°. A loudspeaker located exactly above the central listener position would have an elevation angle of 90°. Loudspeakers arranged below the horizontal listener plane 300 have a negative elevation angle. In FIG. 5, LC has a direction $x_1$, CC has a direction $x_2$, RC has a direction $x_3$ and ECC has a direction $x_4$.

The position of a particular channel in space, i.e. the loudspeaker position associated with the particular channel) is given by the azimuth angle, the elevation angle and the distance of the loudspeaker from the central listener position. It is to be noted that the term "position of a loudspeaker" is often described by those skilled in the art by referring to the azimuth angle and the elevation angle only.

Generally, a format conversion between different loudspeaker channel configurations is performed as a downmixing process that maps a number of input channels to a number of output channels, wherein the number of output channels is generally smaller than the number of input channels, and wherein the output channel positions may differ from the input channel positions. One or more input channels may be mixed together to the same output channel. At the same time, one or more input channels may be rendered over more than one output channel. This mapping from the input channels to the output channel is typically determined by a set of downmix coefficients, or alternatively formulated as a downmix matrix. The choice of downmix coefficients significantly affects the achievable downmix output sound quality. Bad choices may lead to an unbalanced mix or bad spatial reproduction of the input sound scene.

Each channel has associated therewith an audio signal to be reproduced by the associated loudspeaker. The teaching that a specific channel is processed (such as by applying a coefficient, by applying an equalization filter or by applying a decorrelation filter) means that the corresponding audio signal associated with this channel is processed. In the context of this application, the term "equalization filter" is meant to encompass any means to apply an equalization to the signal such that a frequency dependent weighting of portions of the signal is achieved. For example, an equalization filter may be configured to apply frequency-dependent gain coefficients to frequency bands of the signal. In the context of this application, the term "decorrelation filter" is meant to encompass any means to apply a decorrelation to the signal, such as by introducing frequency dependent delays and/or randomized phases to the signal. For example, a decorrelation filter may be configured to apply frequency dependent delay coefficients to frequency bands of the signal and/or to apply randomized phase coefficients to the signal.

In embodiments of the invention, mapping an input channel to one or more output channels includes applying at least one coefficient to be applied to the input channel for each output channel to which the input channel is mapped. The at least one coefficient may include a gain coefficient, i.e. a gain value, to be applied to the input signal associated with the input channel, and/or a delay coefficient, i.e. a delay value to be applied to the input signal associated with the input channel. In embodiments of the invention, mapping may include applying frequency selective coefficients, i.e. different coefficients for different frequency bands of the input channels. In embodiments of the invention, mapping the input channels to the output channels includes generating one or more coefficient matrices from the coefficients. Each matrix defines a coefficient to be applied to each input channel of the input channel configuration for each output channel of the output channel configuration. For output channels, which the input channel is not mapped to, the respective coefficient in the coefficient matrix will be zero. In embodiments of the invention, separate coefficient matrices for gain coefficients and delay coefficients may be generated. In embodiments of the invention, a coefficient matrix for each frequency band may be generated in case the coefficients are frequency selective. In embodiments of the invention, mapping may further include applying the derived coefficients to the input signals associated with the input channels.

To obtain good downmix coefficients, an expert (e.g. a sound engineer) may manually tune the coefficients, taking into account his expert knowledge. Another possibility is to automatically derive downmix coefficients for a given combination of input and output configurations by treating each input channel as a virtual sound source whose position in space is given by the position in space associated with the particular channel, i.e. the loudspeaker position associated with the particular input channel. Each virtual source can be reproduced by a generic panning algorithm like tangent-law panning in 2D or vector base amplitude panning (VBAP) in 3D, see V. Pulkki: "Virtual Sound Source Positioning Using Vector Base Amplitude Panning", Journal of the Audio Engineering Society, vol. 45, pp. 456-466, 1997. Another proposal for a mathematical, i.e. automatic, derivation of downmix coefficients for a given combination of input and output configurations has been made by A. Ando: "Conversion of Multichannel Sound Signal Maintaining Physical Properties of Sound in Reproduced Sound Field", IEEE Transactions on Audio, Speech, and Language Processing, vol. 19, no. 6, August 2011.

Accordingly, existing downmix approaches are mainly based on three strategies for the derivation of downmix coefficients. The first strategy is a direct mapping of discarded input channels to output channels at the same or comparable azimuth position. Elevation offsets are neglected. For example, it is a common practice to render height channels directly with horizontal channels at the same or comparable azimuth position, if the height layer is not present in the output channel configuration. A second strategy is the usage of generic panning algorithms, which treat the input channels as virtual sound sources and preserve azimuth information by introducing phantom sources at the position of discarded input channels. Elevation offsets are neglected. In state of the art methods panning is only used if there is no output loudspeaker available at the desired output position, for example at the desired azimuth angle. A third strategy is the incorporation of expert knowledge for the derivation of optimal downmix coefficients in empirical, artistic or psychoacoustic sense. Separate or combined application of different strategies may be used.

Embodiments of the invention provide for a technical solution allowing to improve or optimize a downmixing process such that higher quality downmix output signals can be obtained than without utilizing this solution. In embodiments, the solution may improve the downmix quality in cases where the spatial diversity inherent to the input channel configuration would be lost during downmixing without applying the proposed solution.

To this end, embodiments of the invention allow preserving the spatial diversity that is inherent to the input channel configuration and that is not preserved by a straightforward downmix (DMX) approach. In downmix scenarios, in which the number of acoustic channels is reduced, embodiments of the invention mainly aim at reducing the loss of diversity and envelopment, which implicitly occurs when mapping from a higher to a lower number of channels.

The inventors recognized that, dependent on the specific configuration, the inherent spatial diversity and the spatial envelopment of an input channel configuration is often considerably decreased or completely lost in the output channel configuration. Furthermore, if auditory events are simultaneously reproduced from several speakers in the input configuration, they get more coherent, condensed and focused in the output configuration. This may lead to a perceptually more pressing spatial impression, which often appears to be less enjoyable than the input channel configuration. Embodiments of the invention aim for an explicit preservation of spatial diversity in the output channel configuration for the first time. Embodiments of the invention aim at preserving the perceived location of an auditory event as close as possible compared to the case of using the original input channel loudspeaker configuration.

Accordingly, embodiments of the invention provide for a specific approach of mapping a first input channel and a second input channel, which are associated with different loudspeaker positions of an input channel configuration and therefore comprise a spatial diversity, to at least one output channel. In embodiments of the invention, the first and second input channels are at different elevations relative to a horizontal listener plane. Thus, elevation offsets between the first input channel and the second input channel may be taken into consideration in order to improve the sound reproduction using the loudspeakers of the output channel configuration.

In the context of this application, diversity can be described as follows. Different loudspeakers of an input channel configuration result in different acoustic channels from loudspeakers to ears, such as ears of the listener at position P. There is a number of direct acoustic paths and a number of indirect acoustic paths, also known as reflections or reverberation, which emerge from a diverse listening room excitement and which add additional decorrelation and timbre changes to the perceived signals from different loudspeaker positions. Acoustic channels can be fully modeled by BRIRs, which are characteristic for each listening room. The listening experience of an input channel configuration is strongly dependent on a characteristic combination of different input channels and diverse BRIRs, which correspond to specific loudspeaker positions. Thus, diversity and envelopment arises from diverse signal modifications, which are inherently applied to all loudspeaker signals by the listening room.

A reasoning for the need of downmix approaches, which preserve the spatial diversity of an input channel configuration is now given. An input channel configuration may utilize more loudspeakers than an output channel configuration or may use at least one loudspeaker not present in the output loudspeaker configuration. Merely for illustration purposes, an input channel configuration may utilize loudspeakers LC, CC, RC, ECC as shown in FIG. 5, while an output channel configuration may utilize loudspeakers LC, CC and RC only, i.e. does not utilize loudspeaker ECC. Thus, the input channel configuration may utilize a higher number of playback layers than the output channel configuration. For example, the input channel configuration may provide both horizontal (LC, CC, RC) and height (ECC) speakers, whereas the output configuration may only provide horizontal speakers (LC, CC, RC). Thus, the number of acoustic channels from loudspeaker to ears is reduced with the output channel configuration in downmix situations. Specifically, 3D (e.g. 22.2) to 2D (e.g. 5.1) downmixes (DMXes) are affected most due to the lack of different reproduction layers in the output channel configuration. The degrees of freedom to achieve a similar listening experience with the output channel configuration with respect to diversity and envelopment are reduced and therefore limited. Embodiments of the invention provide for downmix approaches, which improve preservation of the spatial diversity of an input channel configuration, wherein the described apparatuses and methods are not restricted to any particular kind of downmix approach and may be applied in various contexts and applications.

In the following, embodiments of the invention are described referring to the specific scenario shown in FIG. 5. However, the described problems and solutions can be easily adapted to other scenarios with similar conditions. Without loss of generality, the following input and output channel configurations are assumed:

Input channel configuration: four loudspeakers LC, CC, RC and ECC at positions $x_1=(\alpha_1, \beta_1)$, $x_2=(\alpha_2, \beta_1)$, $x_3=(\alpha_3, \beta_1)$ and $x_4=(\alpha_4, \beta_2)$, wherein $\alpha_2 \approx \alpha_4$ or $\alpha_2=\alpha_4$.

Output channel configuration: three loudspeakers at position $x_1=(\alpha_1, \beta_1)$, $x_2=(\alpha_2, \beta_1)$ and $x_3=(\alpha_3, \beta_1)$, i.e. the loudspeaker at position $x_4$ is discarded in the downmix. $\alpha$ represents the azimuth angle and $\beta$ represents the elevation angle.

As explained above, a straightforward DMX approach would prioritize the preservation of directional azimuth information and just neglect any elevation offset. Thus, signals from loudspeaker ECC at position $x_4$ would be simply passed to loudspeaker CC at position $x_2$. However, when doing so characteristics are lost. Firstly, timbre differences, due to different BRIRs, which are inherently applied at the reproduction positions $x_2$ and $x_4$ are lost. Secondly, spatial diversity of the input signals, which are reproduced at different positions $x_2$ and $x_4$ are lost. Thirdly, an inherent decorrelation of input signals due to different acoustic propagation paths from positions $x_2$ and $x_4$ to the listeners ears is lost.

Embodiments of the invention aim at a preservation or emulation of one or more of the described characteristics by applying the strategies explained herein separately or in combination for the downmixing process.

Figure 6A:
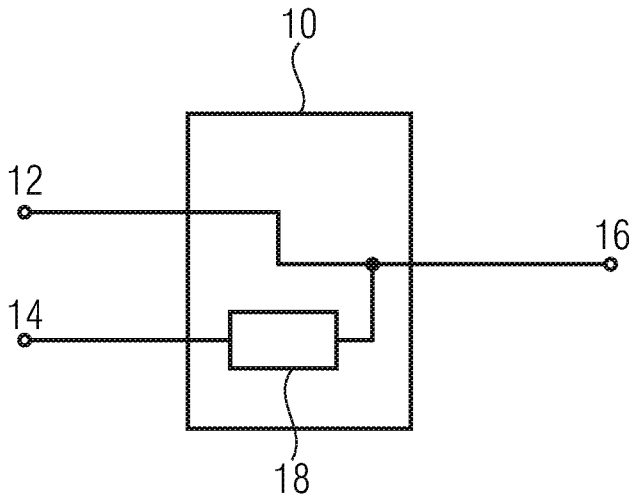
FIGS. 6*a* and 6*b* show schematic views of an apparatus for mapping first and second input channels to an output channel.
Figure 6B:
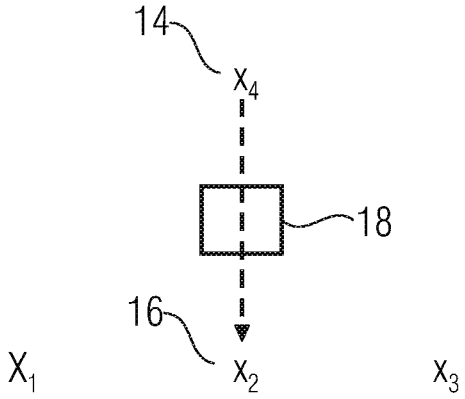

FIGS. 6*a* and 6*b* show schematic views for explaining an apparatus 10 for implementing a strategy, in which a first input channel 12 and a second input channel 14 are mapped to the same output channel 16, wherein processing of the second input channel is performed by applying at least one of an equalization filter and a decorrelation filter to the second input channel. This processing is indicated in FIG. 6*a* by block 18.

It is clear to those skilled in the art that the apparatuses explained and described in the present application may be implemented by means of respective computers or processors configured and/or programmed to obtain the functionality described. Alternatively, the apparatuses may be implemented as other programmed hardware structures, such as field programmable gate arrays and the like.

The first input channel 12 in FIG. 6*a* may be associated with the center loudspeaker CC at direction $x_2$ and the second input channel 14 may be associated with the elevated center loudspeaker ECC at position $x_4$ (in the input channel configuration, respectively). The output channel 16 may be associated with the center loudspeaker ECC at position $x_2$ (in the output channel configuration). FIG. 6*b* illustrates that channel 14 associated with the loudspeaker at position $x_4$ is mapped to the first output channel 16 associated with loudspeaker CC at position $x_2$ and that this mapping comprises processing 18 of the second input channel 14, i.e. processing of the audio signal associated with the second input channel 14. Processing of the second input channel comprises applying at least one of an equalization filter and a decorrelation filter to the second input channel in order to preserve different characteristics between the first and the second input channels in the input channel configuration. In embodiments, the equalization filter and/or the decorrelation filter may be configured to preserve characteristics concerning timbre differences due to different BRIRs, which are inherently applied at the different loudspeaker positions $x_2$ and $x_4$ associated with the first and second input channels. In embodiments of the invention, the equalization filter and/or the decorrelation filter are configured to preserve spatial diversity of input signals, which are reproduced at different positions so that the spatial diversity of the first and second input channel remains perceivable despite the fact that the first and second input channels are mapped to the same output channel.

In embodiments of the invention, a decorrelation filter is configured to preserve an inherent decorrelation of input signals due to different acoustic propagation paths from the different loudspeaker positions associated with the first and second input channels to the listener's ears.

In an embodiment of the invention, an equalization filter is applied to the second input channel, i.e. the audio signal associated with the second input channel at position $x_4$, if it is downmixed to the loudspeaker CC at the position $x_2$. The equalization filter compensates for timbre changes of different acoustical channels and may be derived based on empirical expert knowledge and/or measured BRIR data or the like. For example, it is assumed that the input channel configuration provides a Voice of God (VoG) channel at 90° elevation. If the output channel configuration only provides loudspeakers in one layer and the VoG channel is discarded like, e.g. with a 5.1 output configuration, it is a simple straightforward approach to distribute the VoG channel to all output loudspeakers to preserve the directional information of the VoG channel at least in the sweet spot. However, the original VoG loudspeaker is perceived quite differently due to a different BRIR. By applying a dedicated equalization filter to the VoG channel before the distribution to all output loudspeakers, the timbre difference can be compensated.

Figure 12:
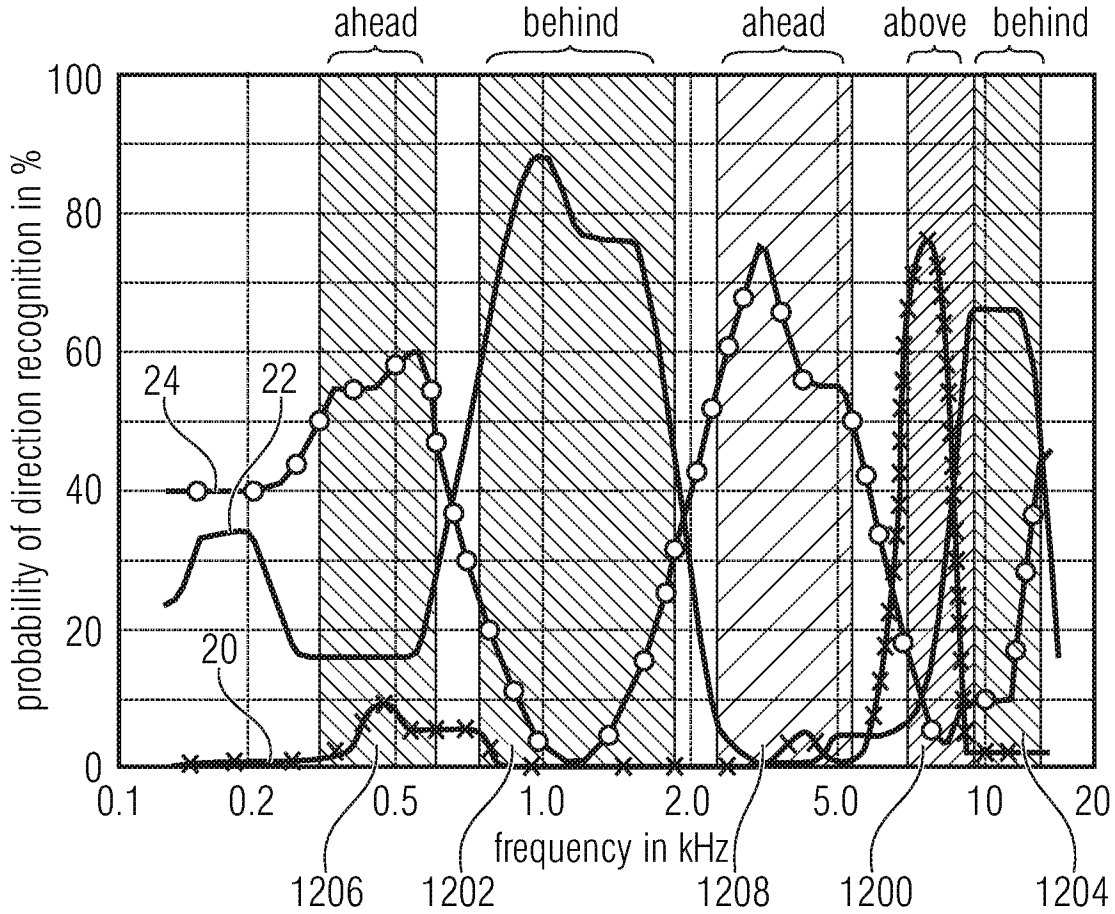
FIG. 12 a diagram showing so-called Blauert bands.

In embodiments of the invention, the equalization filter may be configured to perform a frequency-dependent weighting of the corresponding input channel to take into consideration psychoacoustic findings about directional perception of audio signals. An example of such findings are the so called Blauert bands, representing direction determining bands. FIG. 12 shows three graphs 20, 22 and 24 representing the probability that a specific direction of audio signals is recognized. As can be seen from graph 20, audio signals from above can be recognized with high probability in a frequency band 1200 between 7 kHz and 10 kHz or. As can be seen from graph 22, audio signals from behind can be recognized with high probability in a frequency band 1202 from about 0.7 kHz to about 2 kHz and in a frequency band 1204 from about 10 kHz to about 12.5 kHz. As can be seen from graph 24, audio signals from ahead can be recognized with high probability in a frequency band 1206 from about 0.3 kHz to 0.6 kHz and in a frequency band 1208 from about 2.5 to about 5.5 kHz.

In embodiments of the invention, the equalization filter is configured utilizing this recognition. In other words, the equalization filter may be configured to apply higher gain coefficients (boost) to frequency bands which are known to give a user the impression that sound comes from a specific directions, when compared to the other frequency bands. To be more specific, in case an input channel is mapped to a lower output channel, a spectral portion of the input channel in the frequency band 1200 range between 7 kHz and 10 kHz may be boosted when compared to other spectral portions of the second input channels so that the listener may get the impression that the corresponding signal stems from an elevated position. Likewise, the equalization filter may be configured to boost other spectral portions of the second input channel as shown in FIG. 12. For example, in case an input channel is mapped to an output channel arranged in a more forward position bands 1206 and 1208 may be boosted, and in case an input channel is mapped to an output channel arranged in a more rearward position bands 1202 and 1204 may be boosted.

In embodiments of the invention, the apparatus is configured to apply a decorrelation filter to the second input channel. For example, a decorrelation/reverberation filter may be applied to the input signal associated with the second input channel (associated with the loudspeaker at position $x_4$), if it is downmixed to a loudspeaker at the position $x_2$. Such a decorrelation/reverberation filter may be derived from BRIR measurements or empirical knowledge about room acoustics or the like. If the input channel is mapped to multiple output channels, the filter signal may be reproduced over the multiple loudspeakers, where for each loudspeaker different filters may be applied. The filter(s) may also only model early reflections.

Figure 8:
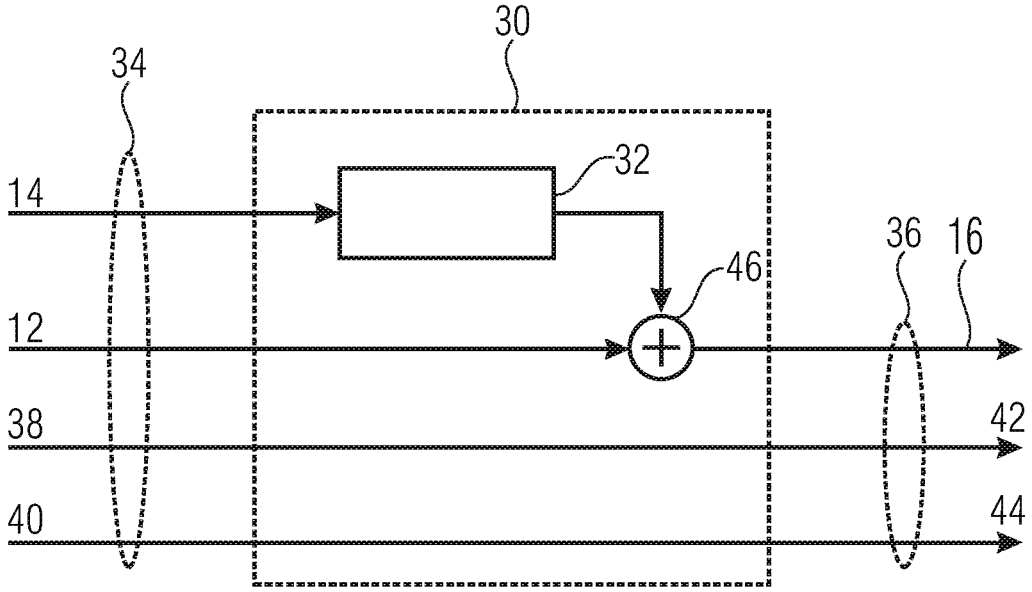
FIG. 8 shows a schematic view of an apparatus for mapping a first and second channel to one output channel.

FIG. 8 shows a schematic view of an apparatus 30 comprising a filter 32, which may represent an equalization filter or a decorrelation filter. The apparatus 30 receives a number of input channels 34 and outputs a number of output channels 36. The input channels 34 represent an input channel configuration and the output channels 36 represent an output channel configuration. As shown in FIG. 8, a third input channel 38 is directly mapped to a second output channel 42 and a fourth input channel 40 is directly mapped to a third output channel 44. The third input channel 38 may be a left channel associated with the left loudspeaker LC. The fourth input channel 40 may be a right input channel associated with the right loudspeaker RC. The second output channel 42 may be a left channel associated with the left loudspeaker LC and the third output channel 44 may be a right channel associated with the right loudspeaker RC. The first input channel 12 may be the center horizontal channel associated with the center loudspeaker CC and the second input channel 14 may be height center channel associated with the elevated center loudspeaker ECC. Filter 32 is applied to the second input channel 14, i.e. the height center channel. The filter 32 may be a decorrelation or reverberation filter. After filtering, the second input channel is routed to the horizontal center loudspeaker, i.e. the first output channel 16 associated with loudspeaker CC at the position $x_2$. Thus, both input channels 12 and 14 are mapped to the first output channel 16, as indicated by block 46 in FIG. 8. In embodiments of the invention, the first input channel 12 and the processed version of the second input channel 14 may be added at block 46 and supplied to the loudspeaker associated with output channel 16, i.e. the center horizontal loudspeaker CC in the embodiment described.

In embodiments of the invention, filter 32 may be a decorrelation or a reverberation filter in order to model the additional room effect perceived when two separate acoustic channels are present. Decorrelation may have the additional benefit that DMX cancellation artifacts may be reduced by this notification. In embodiments of the invention, filter 32 may be an equalization filter and may be configured to perform a timbre equalization. In other embodiments of the invention, a decorrelation filter and a reverberation filter may be applied in order to apply timbre equalization and decorrelation before downmixing the signal of the elevated loudspeaker. In embodiments of the invention, filter 32 may be configured to combine both functionalities, i.e. timbre equalization and decorrelation.

In embodiments of the invention, the decorrelation filter may be implemented as a reverberation filter introducing reverberations into the second input channel. In embodiments of the inventions, the decorrelation filter may be configured to convolve the second input channel with an exponentially decaying noise sequence. In embodiments of the invention, any decorrelation filter may be used that decorrelates the second input channel in order to preserve the impression for a listener in that the signal from the first input channel and the second input channel stem from loudspeakers at different positions.

Figure 7A:
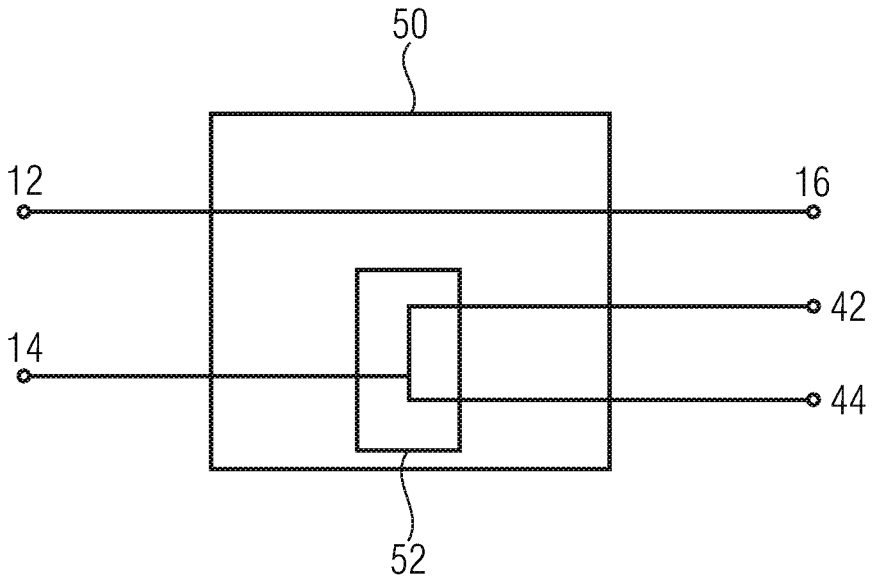
FIGS. 7*a* and 7*b* show schematic views of an apparatus for mapping first and second input channels to several output channels.

FIG. 7*a* shows a schematic view of an apparatus 50 according to another embodiment. The apparatus 50 is configured to receive the first input channel 12 and the second input channel 14. The apparatus 50 is configured to map the first input channel 12 directly to the first output channel 16. The apparatus 50 is further configured to generate a phantom source by panning between second and third output channels, which may be the second output channel 42 and the third output channel 44. This is indicated in FIG. 7*a* by block 52. Thus, a phantom source having an azimuth angle corresponding to the azimuth angle of second input channel is generated.

When considering the scenery in FIG. 5, the first input channel 12 may be associated with the horizontal center loudspeaker CC, the second input channel 14 may be associated with the elevated center loudspeaker ECC, the first output channel 16 may be associated with the center loudspeaker CC, the second output channel 42 may be associated with the left loudspeaker LC and the third output channel 44 may be associated with the right loudspeaker RC. Thus, in the embodiment shown in FIG. 7*a*, a phantom source is placed at position $x_2$ by panning loudspeakers at the positions $x_1$ and $x_3$ instead of directly applying the corresponding signal to the loudspeaker at position $x_2$. Thus, panning between loudspeakers at positions $x_1$ and $x_3$ is performed despite the fact that there is another loudspeaker at the position $x_2$, which is closer to the position $x_4$ than the positions $x_1$ and $x_3$. In other words, panning between loudspeakers at positions $x_1$ and $x_3$ is performed despite of the fact that azimuth angle deviations $\Delta\alpha$ between the respective channels 42, 44 and channel 14 are larger than the azimuth angle deviation between channels 14 and 16, which is 0°, see FIG. 7*b*. By doing so, the spatial diversity introduced by the loudspeakers at positions $x_2$ and $x_4$ is preserved by using a discrete loudspeaker at the position $x_2$ for the signal originally assigned to the corresponding input channel, and a phantom source at the same position. The signal of the phantom source corresponds to the signal of the loudspeaker at position $x_4$ of the original input channel configuration.

Figure 7B:
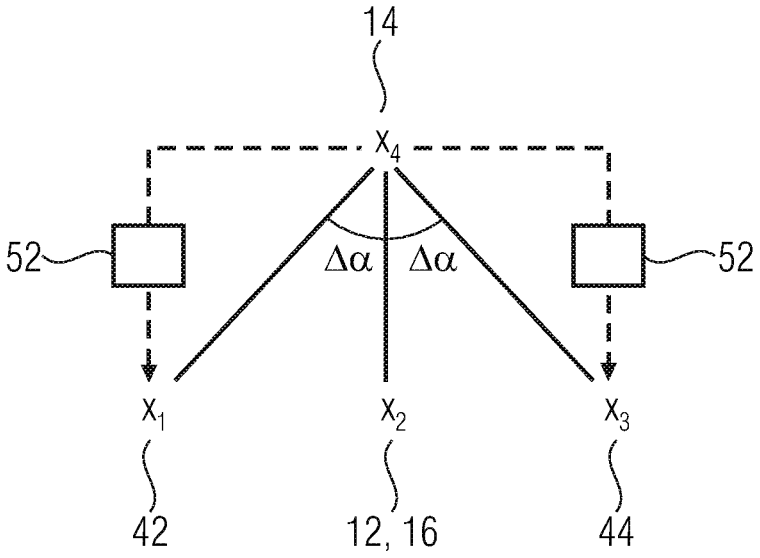

FIG. 7*b* schematically shows the mapping of the input channel associated with the loudspeaker at position $x_4$ by panning 52 between the loudspeaker at positions $x_1$ and $x_3$.

In the embodiments described with respect to FIGS. 7*a* and 7*b*, it is assumed that an input channel configuration provides a height and a horizontal layer including a height center loudspeaker and a horizontal center loudspeaker. Furthermore, it is assumed that the output channel configuration only provides a horizontal layer including a horizontal center loudspeaker and left and right horizontal loudspeakers, which may realize a phantom source at the position of the horizontal center loudspeaker. As explained, in a common straightforward approach, the height center input channel would be reproduced with the horizontal center output loudspeaker. Instead of that, according to the described embodiment of the invention the height center input channel is purposely panned between horizontal left and right output loudspeakers. Thus, the spatial diversity of the height center loudspeaker and the horizontal center loudspeaker of the input channel configuration is preserved by using the horizontal center loudspeaker and a phantom source fed by the height center input channel.

In embodiments of the invention, in addition to panning, an equalization filter may be applied to compensate for possible timbre changes due to different BRIRs.

Figure 9:
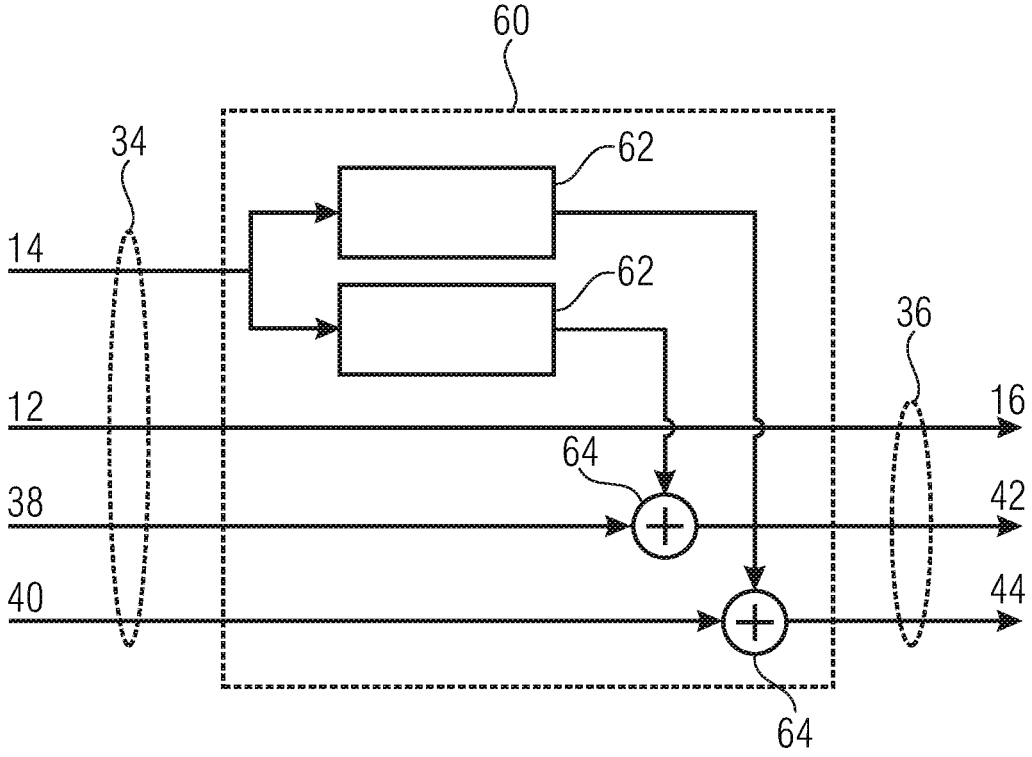
FIG. 9 shows a schematic view of an apparatus for mapping first and second input channels to different output channels.

An embodiment of an apparatus 60 implementing the panning approach is shown in FIG. 9. In FIG. 9, the input channels and the output channels correspond to the input channels and the output channel shown in FIG. 8 and a repeated description thereof is omitted. Apparatus 60 is configured to generate a phantom source by panning between the second and third output channels 42 and 44, as it is shown in FIG. 9 by blocks 62.

In embodiments of the invention, panning may be achieved using common panning algorithms, such as generic panning algorithms like tangent-law panning in 2D or vector base amplitude panning in 3D, see V. Pulkki: "Virtual Sound Source Positioning Using Vector Base Amplitude Panning", Journal of the Audio Engineering Society, vol. 45, pp. 456-466, 1997, and need not be described in more detail herein. The panning gains of the applied panning law determine the gains that are applied when mapping the input channels to the output channels. The respective signals obtained are added to the second and third output channels 42 and 44, see adder blocks 64 in FIG. 9. Thus, the second input channel 14 is mapped to the second and third output channels 42 and 44 by panning in order to generate a phantom source at position $x_2$, the first input channel 12 is directly mapped to the first output channel 16, and third and fourth input channels 38 and 40 are also mapped directly to the second and third output channels 42 and 44.

In alternative embodiments, block 62 may be modified in order to additionally provide for the functionality of an equalization filter in addition to the panning functionality. Thus, possible timbre changes due to different BRIRs can be compensated for in addition to preserving spatial diversity by the panning approach.

Figure 10:
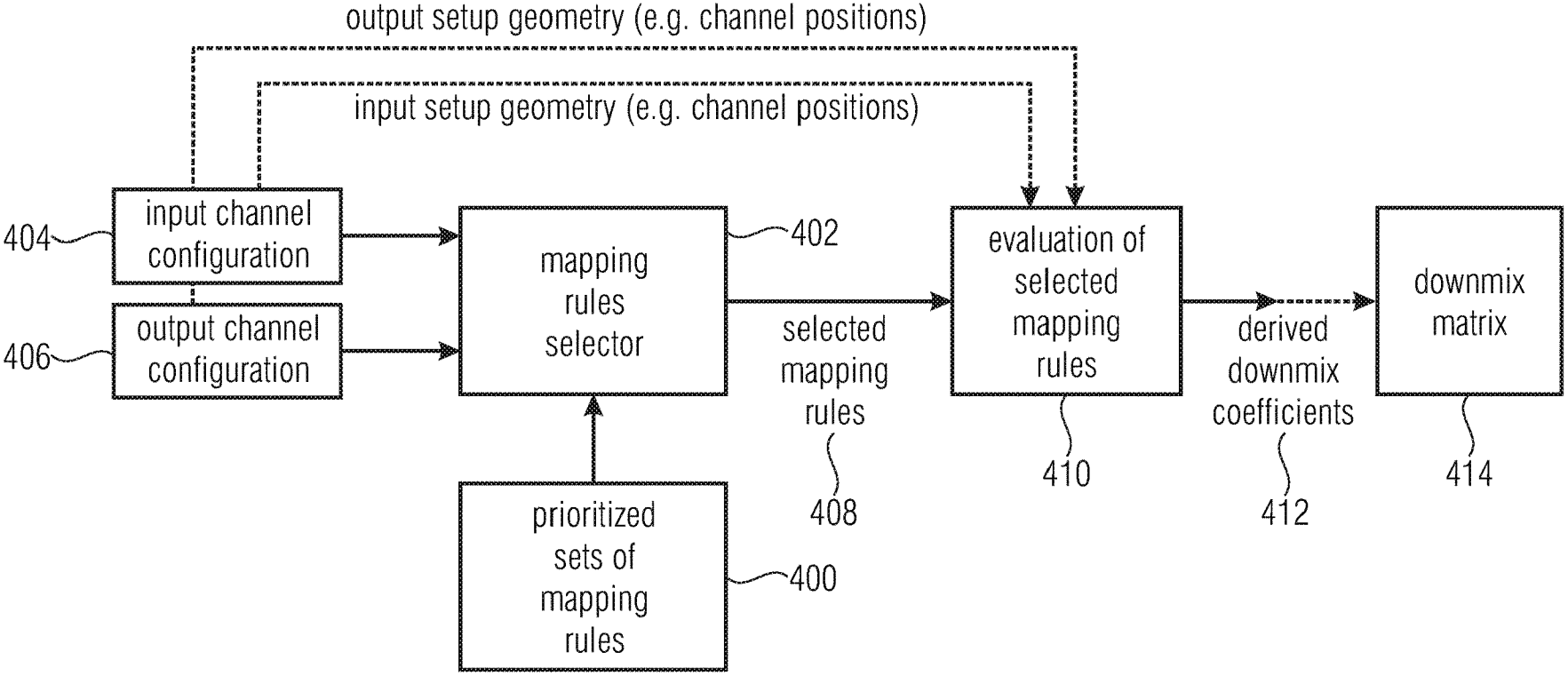
FIG. 10 shows a block diagram of a signal processing unit for mapping input channels of an input channel configuration to output channels of an output channel configuration.

FIG. 10 shows a system for generating a DMX matrix, in which the present invention my be embodied. The system comprises sets of rules describing potential input-output channel mappings, block 400, and a selector 402 that selects the most appropriate rules for a given combination of an input channel configuration 404 and an output channel configuration combination 406 based on the sets of rules 400. The system may comprise an appropriate interface to receive information on the input channel configuration 404 and the output channel configuration 406. The input channel configuration defines the channels present in an input setup, wherein each input channel has associated therewith a direction or position. The output channel configuration defines the channels present in the output setup, wherein each output channel has associated therewith a direction or position. The selector 402 supplies the selected rules 408 to an evaluator 410. The evaluator 410 receives the selected rules 408 and evaluates the selected rules 408 to derive DMX coefficients 412 based on the selected rules 408. A DMX matrix 414 may be generated from the derived downmix coefficients. The evaluator 410 may be configured to derive the downmix matrix from the downmix coefficients. The evaluator 410 may receive information on the input channel configuration and the output channel configuration, such as information on the output setup geometry (e.g. channel positions) and information on the input setup geometry (e.g. channel positions) and take the information into consideration when deriving the DMX coefficients.

Figure 11:
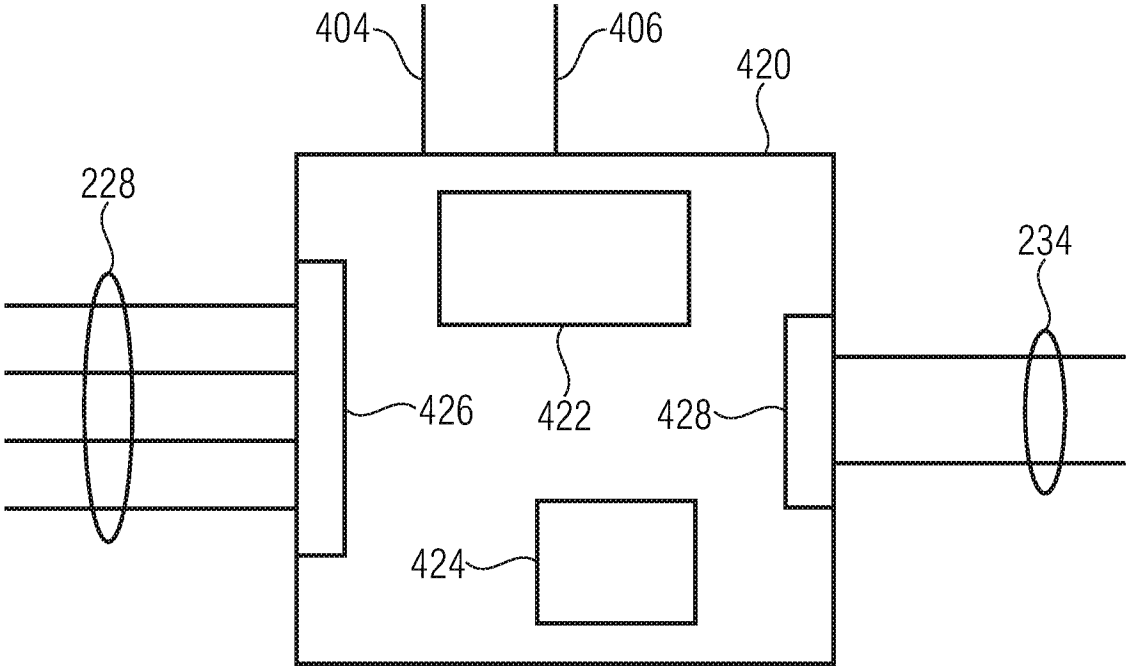
FIG. 11 shows a signal processing unit.

As shown in FIG. 11, the system may be implemented in a signal processing unit 420 comprising a processor 422 programmed or configured to act as the selector 402 and the evaluator 410 and a memory 424 configured to store at least part of the sets 400 of mapping rules. Another part of the mapping rules may be checked by the processor without accessing the rules stored in memory 422. In either case, the rules are provided to the processor in order to perform the described methods. The signal processing unit may include an input interface 426 for receiving the input signals 228 associated with the input channels and an output interface 428 for outputting the output signals 234 associated with the output channels.

Some of the rules 400 may be designed so that the signal processing unit 420 implements an embodiment of the invention. Exemplary rules for mapping an input channel to one or more output channels are given in Table 1.

TABLE 1

| Mapping Rules | | | |
|---|---|---|---|
| Input (Source) | Output (Destination) | Gain | EQ index |
| CH_M_000 | CH_M_L030, CH_M_R030 | 1.0 | 0 (off) |
| CH_M_L060 | CH_M_L030, CH_M_L110 | 1.0 | 0 (off) |
| CH_M_L060 | CH_M_L030 | 0.8 | 0 (off) |
| CH_M_R060 | CH_M_R030, CH_M_R110, | 1.0 | 0 (off) |
| CH_M_R060 | CH_M_R030, | 0.8 | 0 (off) |
| CH_M_L090 | CH_M_L030, CH_M_L110 | 1.0 | 0 (off) |
| CH_M_L090 | CH_M_L030 | 0.8 | 0 (off) |
| CH_M_R090 | CH_M_R030, CH_M_R110 | 1.0 | 0 (off) |
| CH_M_R090 | CH_M_R030 | 0.8 | 0 (off) |
| CH_M_L110 | CH_M_L135 | 1.0 | 0 (off) |
| CH_M_L110 | CH_M_L030 | 0.8 | 0 (off) |
| CH_M_R110 | CH_M_R135 | 1.0 | 0 (off) |
| CH_M_R110 | CH_M_R030 | 0.8 | 0 (off) |
| CH_M_L135 | CH_M_L110 | 1.0 | 0 (off) |
| CH_M_L135 | CH_M_L030 | 0.8 | 0 (off) |
| CH_M_R135 | CH_M_R110 | 1.0 | 0 (off) |
| CH_M_R135 | CH_M_R030 | 0.8 | 0 (off) |
| CH_M_180 | CH_M_R135, CH_M_L135 | 1.0 | 0 (off) |
| CH_M_180 | CH_M_R110, CH_M_L110 | 1.0 | 0 (off) |
| CH_M_180 | CH_M_R030, CH_M_L030 | 0.6 | 0 (off) |
| CH_U_000 | CH_U_L030, CH_U_R030 | 1.0 | 0 (off) |
| CH_U_000, | CH_M_L030, CH_M_R030 | 0.85 | 0 (off) |
| CH_U_L045 | CH_U_L030 | 1.0 | 0 (off) |
| CH_U_L045 | CH_M_L030 | 0.85 | 1 |
| CH_U_R045 | CH_U_R030 | 1.0 | 0 (off) |
| CH_U_R045 | CH_M_R030 | 0.85 | 1 |
| CH_U_L030 | CH_U_L045 | 1.0 | 0 (off) |
| CH_U_L030 | CH_M_L030 | 0.85 | 1 |
| CH_U_R030 | CH_U_R045 | 1.0 | 0 (off) |
| CH_U_R030 | CH_M_R030 | 0.85 | 1 |
| CH_U_L090 | CH_U_L030, CH_U_L110 | 1.0 | 0 (off) |

TABLE 1-continued

| Mapping Rules | | | |
|---|---|---|---|
| Input (Source) | Output (Destination) | Gain | EQ index |
| CH_U_L090 | CH_U_L030, CH_U_L135 | 1.0 | 0 (off) |
| CH_U_L090 | CH_U_L045 | 0.8 | 0 (off) |
| CH_U_L090 | CH_U_L030 | 0.8 | 0 (off) |
| CH_U_L090 | CH_M_L030, CH_M_L110 | 0.85 | 2 |
| CH_U_L090 | CH_M_L030 | 0.85 | 2 |
| CH_U_R090 | CH_U_R030, CH_U_R110 | 1.0 | 0 (off) |
| CH_U_R090 | CH_U_R030, CH_U_R135 | 1.0 | 0 (off) |
| CH_U_R090 | CH_U_R045 | 0.8 | 0 (off) |
| CH_U_R090 | CH_U_R030 | 0.8 | 0 (off) |
| CH_U_R090 | CH_M_R030, CH_M_R110 | 0.85 | 2 |
| CH_U_R090 | CH_M_R030 | 0.85 | 2 |
| CH_U_L110 | CH_U_L135 | 1.0 | 0 (off) |
| CH_U_L110 | CH_U_L030 | 0.8 | 0 (off) |
| CH_U_L110 | CH_M_L110 | 0.85 | 2 |
| CH_U_L110 | CH_M_L030 | 0.85 | 2 |
| CH_U_R110 | CH_U_R135 | 1.0 | 0 (off) |
| CH_U_R110 | CH_U_R030 | 0.8 | 0 (off) |
| CH_U_R110 | CH_M_R110 | 0.85 | 2 |
| CH_U_R110 | CH_M_R030 | 0.85 | 2 |
| CH_U_L135 | CH_U_L110 | 1.0 | 0 (off) |
| CH_U_L135 | CH_U_L030 | 0.8 | 0 (off) |
| CH_U_L135 | CH_M_L110 | 0.85 | 2 |
| CH_U_L135 | CH_M_L030 | 0.85 | 2 |
| CH_U_R135 | CH_U_R110 | 1.0 | 0 (off) |
| CH_U_R135 | CH_U_R030 | 0.8 | 0 (off) |
| CH_U_R135 | CH_M_R110 | 0.85 | 2 |
| CH_U_R135 | CH_M_R030 | 0.85 | 2 |
| CH_U_180 | CH_U_R135, CH_U_L135 | 1.0 | 0 (off) |
| CH_U_180 | CH_U_R110, CH_U_L110 | 1.0 | 0 (off) |
| CH_U_180 | CH_M_180 | 0.85 | 2 |
| CH_U_180 | CH_M_R110, CH_M_L110 | 0.85 | 2 |
| CH_U_180 | CH_U_R030, CH_U_L030 | 0.8 | 0 (off) |
| CH_U_180 | CH_M_R030, CH_M_L030 | 0.85 | 2 |
| CH_T_000 | ALL_U | 1.0 | 3 |
| CH_T_000 | ALL_M | 1.0 | 4 |
| CH_L_000 | CH_M_000 | 1.0 | 0 (off) |
| CH_L_000 | CH_M_L030, CH_M_R030 | 1.0 | 0 (off) |
| CH_L_000 | CH_M_L030, CH_M_R060 | 1.0 | 0 (off) |
| CH_L_000 | CH_M_L060, CH_M_R030 | 1.0 | 0 (off) |
| CH_L_L045 | CH_M_L030 | 1.0 | 0 (off) |
| CH_L_R045 | CH_M_R030 | 1.0 | 0 (off) |
| CH_LFE1 | CH_LFE2 | 1.0 | 0 (off) |
| CH_LFE1 | CH_M_L030, CH_M_R030 | 1.0 | 0 (off) |
| CH_LFE2 | CH_LFE1 | 1.0 | 0 (off) |
| CH_LFE2 | CH_M_L030, CH_M_R030 | 1.0 | 0 (off) |

The labels used in table 1 for the respective channels are to be interpreted as follows: Characters "CH" stand for "Channel". Character "M" stands for "horizontal listener plane", i.e. an elevation angle of 0°. This is the plane in which loudspeakers are located in a normal 2D setup such as stereo or 5.1. Character "L" stands for a lower plane, i.e. an elevation angle<0°. Character "U" stands for a higher plane, i.e. an elevation angle>0°, such as 30° as an upper loudspeaker in a 3D setup. Character "T" stands for top channel, i.e. an elevation angle of 90°, which is also known as "voice of god" channel. Located after one of the labels M/L/U/T is a label for left (L) or right (R) followed by the azimuth angle. For example, CH_M_L030 and CH_M_R030 represent the left and right channel of a conventional stereo setup. The azimuth angle and the elevation angle for each channel are indicated in Table 1, except for the LFE channels and the last empty channel.

Table 1 shows a rules matrix in which one or more rules are associated with each input channel (source channel). As can be seen from Table 1, each rule defines one or more output channels (destination channels), which the input channel is to be mapped to. In addition, each rule defines gain value G in the third column thereof. Each rule further defines an EQ index indicating whether an equalization filter is to be applied or not and, if so, which specific equalization filter (EQ index 1 to 4) is to be applied. Mapping of the input channel to one output channel is performed with the gain G given in column 3 of Table 1. Mapping of the input channel to two output channels (indicated in the second column) is performed by applying panning between the two output channels, wherein panning gains $g_1$ and $g_2$ resulting from applying the panning law are additionally multiplied by the gain given by the respective rule (column three in Table 1). Special rules apply for the top channel. According to a first rule, the top channel is mapped to all output channels of the upper plane, indicated by ALL_U, and according to a second (less prioritized) rule, the top channel is mapped to all output channels of the horizontal listener plane, indicated by ALL_M.

When considering the rules indicated in Table 1, the rules defining mapping of channel CH_U_000 to left and right channels represent an implementation of an embodiment of the invention. In addition, the rules defining that equalization is to be applied represent implementations of embodiments of the invention.

As can be seen from Table 1, one of equalizer filters 1 to 4 is applied if an elevated input channel is mapped to one or more lower channels. Equalizer gain values $G_{EQ}$ may be determined as follows based on normalized center frequencies given in Table 2 and based on parameters given in Table 3.

TABLE 2

| Normalized Center Frequencies of 77 Filterbank Bands Normalized Frequency [0, 1] |
|---|
| 0.00208330 |
| 0.00587500 |
| 0.00979170 |
| 0.01354200 |
| 0.01691700 |
| 0.02008300 |
| 0.00458330 |
| 0.00083333 |
| 0.03279200 |
| 0.01400000 |
| 0.01970800 |
| 0.02720800 |
| 0.03533300 |
| 0.04283300 |
| 0.04841700 |
| 0.02962500 |
| 0.05675000 |
| 0.07237500 |
| 0.08800000 |
| 0.10362000 |
| 0.11925000 |
| 0.13487000 |
| 0.15050000 |
| 0.16612000 |
| 0.18175000 |
| 0.19737000 |
| 0.21300000 |
| 0.22862000 |
| 0.24425000 |
| 0.25988000 |
| 0.27550000 |
| 0.29113000 |
| 0.30675000 |
| 0.32238000 |
| 0.33800000 |
| 0.35363000 |
| 0.36925000 |
| 0.38488000 |
| 0.40050000 |
| 0.41613000 |
| 0.43175000 |
| 0.44738000 |

TABLE 2-continued

| Normalized Center Frequencies of 77 Filterbank Bands Normalized Frequency [0, 1] |
|---|
| 0.46300000 |
| 0.47863000 |
| 0.49425000 |
| 0.50987000 |
| 0.52550000 |
| 0.54112000 |
| 0.55675000 |
| 0.57237000 |
| 0.58800000 |
| 0.60362000 |
| 0.61925000 |
| 0.63487000 |
| 0.65050000 |
| 0.66612000 |
| 0.68175000 |
| 0.69737000 |
| 0.71300000 |
| 0.72862000 |
| 0.74425000 |
| 0.75987000 |
| 0.77550000 |
| 0.79112000 |
| 0.80675000 |
| 0.82237000 |
| 0.83800000 |
| 0.85362000 |
| 0.86925000 |
| 0.88487000 |
| 0.90050000 |
| 0.91612000 |
| 0.93175000 |
| 0.94737000 |
| 0.96300000 |
| 0.97454000 |
| 0.99904000 |

TABLE 3

| Equalizer Parameters | | | | |
|---|---|---|---|---|
| Equalizer | $P_f$[Hz] | $P_Q$ | $P_g$[dB] | g [dB] |
| $G_{EQ,1}$ | 12000 | 0.3 | −2 | 1.0 |
| $G_{EQ,2}$ | 12000 | 0.3 | −3.5 | 1.0 |
| $G_{EQ,3}$ | 200, 1300, 600 | 0.3, 0.5, 1.0 | −6.5, 1.8, 2.0 | 0.7 |
| $G_{EQ,4}$ | 5000, 1100 | 1.0, 0.8 | 4.5, 1.8 | −3.1 |
| $G_{EQ,5}$ | 35 | 0.25 | −1.3 | 1.0 |

$G_{EQ}$ consists of gain values per frequency band k and equalizer index e. Five predefined equalizers are combinations of different peak filters. As can be seen from Table 3, equalizers $G_{EQ,1}$, $G_{EQ,2}$ and $G_{EQ,5}$ include a single peak filter, equalizer $G_{EQ,3}$ includes three peak filters and equalizer $G_{EQ,4}$ includes two peak filters. Each equalizer is a serial cascade of one or more peak filters and a gain:

$$G_{EQ,e}^{k} = 10^{\frac{g}{20}} \prod_{n=1}^{N} \text{peak}(\text{band}(k) \cdot f_s/2,\ P_{f,n},\ P_{Q,n},\ P_{g,n})$$

where band(k) is the normalized center frequency of frequency band j, specified in Table 2, $f_s$ is the sampling frequency, and function peak( ) is for negative G $$\text{peak}(b, f, Q, G) = \sqrt{\frac{b^4 + \left(\frac{1}{Q^2} - 2\right) f^2 b^2 + f^4}{b^4 + \left(\frac{10^{\frac{-G}{10}}}{Q^2} - 2\right) f^2 b^2 + f^4}} \quad \text{Equation 1}$$

and otherwise $$\text{peak}(b, f, Q, G) = \sqrt{\frac{b^4 + \left(\frac{10^{\frac{-G}{10}}}{Q^2} - 2\right) f^2 b^2 + f^4}{b^4 + \left(\frac{1}{Q^2} - 2\right) f^2 b^2 + f^4}} \quad \text{Equation 2}$$

The parameters for the equalizers are specified in Table 3. In the above Equations 1 and 2, b is given by band(k)·$f_s$/2, Q is given by $P_Q$ for the respective peak filter (1 to n), G is given by $P_g$ for the respective peak filter, and f is given by $P_f$ for the respective peak filter.

As an example, the equalizer gain values $G_{EQ,4}$ for the equalizer having the index 4 are calculated with the filter parameters taken from the according row of Table 3. Table 3 lists two parameter sets for peak filters for $G_{EQ,4}$, i.e. sets of parameters for n=1 and n=2. The parameters are the peak-frequency $P_f$ in Hz, the peak filter quality factor $P_Q$, the gain $P_g$ (in dB) that is applied at the peak-frequency, and an overall gain g in dB that is applied to the cascade of the two peak filters (cascade of filters for parameters n=1 and n=2).

Thus $$\begin{aligned} G^k_{EQ,e} &= 10^{\frac{-3.1}{20}} \cdot \text{peak}(\text{band}(k) \cdot f_s/2, P_{f,1}, P_{Q,1}, P_{g,1}) \cdot \\ &\quad \text{peak}(\text{band}(k) \cdot f_s/2, P_{f,2}, P_{Q,2}, P_{g,2}) = \\ &\quad 10^{\frac{-3.1}{20}} \cdot \text{peak}(\text{band}(k) \cdot f_s/2, 5000, 1.0, 4.5) \cdot \\ &\quad \text{peak}(\text{band}(k) \cdot f_s/2, 1100, 0.8, 1.8) = \\ &\quad 10^{\frac{-3.1}{20}} \cdot \sqrt{\frac{b^4 + \left(\frac{10^{\frac{4.5}{10}}}{1^2} - 2\right) 5000^2 b^2 + 5000^4}{b^4 + \left(\frac{1}{1^2} - 2\right) 5000^2 b^2 + 5000^4}} \cdot \\ &\quad \sqrt{\frac{b^4 + \left(\frac{10^{\frac{1.8}{1.0}}}{0.8^2} - 2\right) 1100^2 b^2 + 1100^4}{b^4 + \left(\frac{1}{0.8^2} - 2\right) 1100^2 b^2 + 1100^4}} \end{aligned}$$

The equalizer definition as stated above defines zero-phase gains $G_{EQ,4}$ independently for each frequency band k. Each band k is specified by its normalized center frequency band(k) where 0<=band<=1. Note that the normalized frequency band=1 corresponds to the unnormalized frequency $f_s$/2, where $f_s$ denotes the sampling frequency. Therefore band (k)·$f_s$/2 denotes the unnormalized center frequency of band k in Hz.

Thus, different equalizer filter that may be used in embodiments of the invention have been described. It is, however, clear that the description of these equalization filters is for illustrative purposes and that other equalization filters or decorrelation filters may be used in other embodiments.

Table 4 shows exemplary channels having associated therewith a respective azimuth angle and elevation angle.

TABLE 4

Channels with corresponding azimuth and elevation angles

| Channel | Azimuth [deq] | Elevation [deq] |
|---|---|---|
| CH_M_000 | 0 | 0 |
| CH_M_L030 | +30 | 0 |
| CH_M_R030 | −30 | 0 |
| CH_M_L060 | +60 | 0 |
| CH_M_R060 | −60 | 0 |
| CH_M_L090 | +90 | 0 |
| CH_M_R090 | −90 | 0 |
| CH_M_L110 | +110 | 0 |
| CH_M_R110 | −110 | 0 |
| CH_M_L135 | +135 | 0 |
| CH_M_R135 | −135 | 0 |
| CH_M_180 | 180 | 0 |
| CH_U_000 | 0 | +35 |
| CH_U_L045 | +45 | +35 |
| CH_U_R045 | −45 | +35 |
| CH_U_L030 | +30 | +35 |
| CH_U_R030 | −30 | +35 |
| CH_U_L090 | +90 | +35 |
| CH_U_R090 | −90 | +35 |
| CH_U_L110 | +110 | +35 |
| CH_U_R110 | −110 | +35 |
| CH_U_L135 | +135 | +35 |
| CH_U_R135 | −135 | +35 |
| CH_U_180 | 180 | +35 |
| CH_T_000 | 0 | +90 |
| CH_L_000 | 0 | −15 |
| CH_L_L045 | +45 | −15 |
| CH_L_R045 | −45 | −15 |
| CH_LFE1 | n/a | n/a |
| CH_LFE2 | n/a | n/a |
| CH_EMPTY | n/a | n/a |

In embodiments of the invention, panning between two destination channels may be achieved by applying tangent law amplitude panning. In panning a source channel to a first and second destination channel, a gain coefficient $G_1$ is calculated for the first destination channel and a gain coefficient $G_2$ is calculated for the second destination channel:

$G_1$=(value of Gain column in Table 4)*$g_1$, and $G_2$=(value of Gain column of Table 4)*$g_2$.

Gains $g_1$ and $g_2$ are computed by applying tangent law amplitude panning in the following way:

- unwrap source destination channel azimuth angles to be positive
- the azimuth angles of the destination channels are $\alpha_1$ and $\alpha_2$ (see Table 4).
- the azimuth angle of the source channel (panning target) is $\alpha_{src}$.

$$\begin{aligned} \alpha_0 &= \frac{|\alpha_1 - \alpha_2|}{2} \\ \alpha_{center} &= \frac{\alpha_1 + \alpha_2}{2} \\ \alpha &= (\alpha_{center} - \alpha_{src}) \cdot \text{sgn}(\alpha_2 - \alpha_1) \\ g_1 &= \frac{g}{\sqrt{1+g^2}}, \; g_2 = \frac{1}{\sqrt{1+g^2}} \text{ with } g = \frac{\tan\alpha_0 - \tan\alpha + 10^{-10}}{\tan\alpha_0 + \tan\alpha + 10^{-10}} \end{aligned}$$

In other embodiments, different panning laws may be applied.

In principle, embodiments of the invention aim at modeling a higher number of acoustic channels in the input channel configuration by means of changed channel mappings and signal modifications in the output channel configuration. Compared to straightforward approaches, which are often reported to be spatially more pressing, less diverse and less enveloping than the input channel configuration, the spatial diversity and overall listening experience may be improved and more enjoyable by employing embodiments of the invention.

In other words, in embodiments of the invention two or more input channels are mixed together in a downmixing application, wherein a processing module is applied to one of the input signals to preserve the different characteristics of the different transmission paths from the original input channels to the listener's ears. In embodiments of the invention, the processing module may involve filters that modify the signal characteristics, e.g. equalizing filters or decorrelation filters. Equalizing filters may in particular compensate for the loss of different timbres of input channels with different elevation assigned to them. In embodiments of the invention, the processing module may route at least one of the input signals to multiple output loudspeakers to generate a different transmission path to the listener, thus preserving spatial diversity of the input channels. In embodiments of the invention, filter and routing modifications may be applied separately or in combination. In embodiments of the invention, the processing module output may be reproduced over one or multiple loudspeakers.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus. In embodiments of the invention, the methods described herein are processor-implemented or computer-implemented.

Depending on certain implementation requirements, embodiments of the invention can be implemented in hardware or in software. The implementation can be performed using a non-transitory storage medium such as a digital storage medium, for example a floppy disc, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may, for example, be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive method is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the invention method is, therefore, a data stream or a sequence of signals representing the computer program for performing one of the methods described herein. The data stream or the sequence of signals may, for example, be configured to be transferred via a data communication connection, for example, via the internet.

A further embodiment comprises a processing means, for example, a computer or a programmable logic device, programmed to, configured to, or adapted to, perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example, a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. An apparatus for mapping a first input loudspeaker channel and a second input loudspeaker channel of an input loudspeaker channel configuration to at least one output loudspeaker channel of an output loudspeaker channel configuration, wherein each of the first and second input loudspeaker channels has a loudspeaker location direction relative to a central listener position and the output loudspeaker channel has a loudspeaker location direction relative to the central listener position, wherein the first and second input loudspeaker channels comprise different elevation angles relative to a horizontal listener plane, the apparatus comprising:

a processor to receive the first input loudspeaker channel and the second input loudspeaker channel;

map the first input loudspeaker channel to a first output loudspeaker channel of the output loudspeaker channel configuration;

map the second input loudspeaker channel to the first output loudspeaker channel, comprising processing the second input loudspeaker channel by applying an equalization filter to the second input loudspeaker channel to preserve spatial diversity of the first and second input loudspeaker channels; and output the first output loudspeaker channel, wherein the processor is implemented in hardware as a microprocessor, a programmable computer, an electronic circuit or a programmable logic device, wherein mapping the first input loudspeaker channel and the second input loudspeaker channel to the first output loudspeaker channel comprises combining the first input loudspeaker channel and the processed second input loudspeaker channel to the first output loudspeaker channel, wherein the apparatus is configured to perform mapping according to the following mapping rules:

| Input (Source) | Output (Destination) | Gain | EQ index |
|---|---|---|---|
| CH_U_L045 | CH_M_L030 | 0.85 | 1 |
| CH_U_R045 | CH_M_R030 | 0.85 | 1 |
| CH_U_L030 | CH_M_L030 | 0.85 | 1 |
| CH_U_R030 | CH_M_R030 | 0.85 | 1 |
| CH_U_L090 | CH_M_L030 | 0.85 | 2 |
| CH_U_R090 | CH_M_R030 | 0.85 | 2 |
| CH_U_L110 | CH_M_L110 | 0.85 | 2 |
| CH_U_L110 | CH_M_L030 | 0.85 | 2 |
| CH_U_R110 | CH_M_R110 | 0.85 | 2 |
| CH_U_R110 | CH_M_R030 | 0.85 | 2 |
| CH_U_L135 | CH_M_L110 | 0.85 | 2 |
| CH_U_L135 | CH_M_L030 | 0.85 | 2 |
| CH_U_R135 | CH_M_R110 | 0.85 | 2 |
| CH_U_R135 | CH_M_R030 | 0.85 | 2 |
| CH_U_180 | CH_M_180 | 0.85 | 2 |

wherein characters "CH" stand for "channel", character "M" stands for an elevation angle of 0°, character "U" stands for an elevation angle >0°, after one of the labels M/U is a label for left (L) or right (R) followed by the azimuth angle, Gain is a gain used in mapping of the respective input loudspeaker channel to the respective output loudspeaker channel, and EQ index indicates which equalizer is to be applied, with the following equalizer parameters for equalizers 1 and 2:

| Equalizer | $P_f$ [Hz] | $P_Q$ | $P_g$[dB] | g [dB] |
|---|---|---|---|---|
| $G_{EQ,1}$ | 12000 | 0.3 | −2 | 1.0 |
| $G_{EQ,2}$ | 12000 | 0.3 | | |

wherein $G_{EQ,e}$ consists of gain values per frequency band k and equalizer index e, $P_f$ is the peak-frequency in Hz, $P_Q$ is a peak filter quality factor, $P_g$ is a gain in dB applied to the peak frequency, and q in dB is an overall gain applied to the peak filter, wherein equalizers $G_{EQ,1}$, $G_{EQ,2}$ include a single peak filter, wherein each equalizer is a serial cascade of one peak filter and a gain:

$$G_{EQ,e}^{k} = 10^{\frac{g}{20}} peak(band(k) \cdot f_s/2, P_f, P_Q, P_g)$$

where band(k) is the normalized center frequency of each frequency band, $f_s$ is the sampling frequency, and function peak()

$$peak(b, f, Q, G) = \sqrt{\frac{b^4 + \left(\frac{1}{Q^2} - 2\right) f^2 b^2 + f^4}{b^4 + \left(\frac{10^{\frac{-G}{10}}}{Q^2} - 2\right) f^2 b^2 + f^4}}$$

wherein b is given bv band(k)·fs/2, Q is given by $P_Q$ for the respective peak filter, G is given by $P_g$ for the respective peak filter, and f is given by $P_f$ for the respective peak filter, wherein each band k is specified by its normalized center frequency band(k) where 0<=band<=1, wherein the normalized frequency band=1 corresponds to the unnormalized frequency $f_s$/2, where $f_s$ denotes the sampling frequency, and band(k)·$f_{s/2}$ denotes the unnormalized center frequency of band k in Hz.

2. The apparatus of claim 1, wherein the equalization filter is configured to boost a spectral portion of the second input loudspeaker channel when compared to other spectral portions of the second input loudspeaker channel, wherein the spectral portion which is boosted gives the listener the impression that sound comes from a position corresponding to a position of the second input loudspeaker channel.

3. The apparatus of claim 2, wherein a direction of the second input loudspeaker channel has an elevation angle larger than an elevation angle of the first output loudspeaker channel which the second input loudspeaker channel is mapped to, and wherein the spectral portion which is boosted is in a frequency range between 3 kHz and 7.5 kHz.

4. The apparatus of claim 1, wherein the equalization filter is configured to process the second input loudspeaker channel in order to compensate for timbre differences caused by the different directions of the second input loudspeaker channel and the first output loudspeaker channel which the second input loudspeaker channel is mapped to.

5. The apparatus of claim 1, configured to additionally apply a decorrelation filter to the second input loudspeaker channel, wherein the decorrelation filter is configured to introduce frequency dependent delays and/or randomized phases into the second input loudspeaker channel.

6. The apparatus of claim 1, configured to additionally apply a decorrelation filter to the second input loudspeaker channel, wherein the decorrelation filter is a reverberation filter.

7. The apparatus of claim 1, configured to additionally apply a decorrelation filter to the second input loudspeaker channel, wherein the decorrelation filter is configured to convolve the second input loudspeaker channel with an exponentially decaying noise sequence.

8. The apparatus of claim 1, wherein coefficients of the equalization filter are set based on a measured binaural room impulse response of a specific listening room or are set based on empirical knowledge about room acoustics.

9. A method for mapping a first input loudspeaker channel and a second input loudspeaker channel of an input loudspeaker channel configuration to at least one output loudspeaker channel of an output loudspeaker channel configuration, wherein each of the input loudspeaker channels comprises a loudspeaker location direction relative to a central listener position and each of the output loudspeaker channels comprises a loudspeaker location direction relative to the central listener position, wherein the first and second input loudspeaker channels comprise different elevation angles relative to a horizontal listener plane, comprising:

receiving the first input loudspeaker channel and the second input loudspeaker channel;

mapping the first input loudspeaker channel to a first output loudspeaker channel of the output loudspeaker channel configuration;

mapping the second input loudspeaker channel to the first output loudspeaker channel, comprising processing the second input loudspeaker channel by applying an equalization filter to the second input loudspeaker channel to preserve spatial diversity of the first and second input loudspeaker channels; and outputting the first output loudspeaker channel, wherein mapping the first input loudspeaker channel and the second input loudspeaker channel to the first output loudspeaker channel comprises combining the first input loudspeaker channel and the processed second input loudspeaker channel to the first output loudspeaker channel, wherein mapping is performed according to the following mapping rules:

| Input (Source) | Output (Destination) | Gain | EQ index |
|---|---|---|---|
| CH_U_L045 | CH_M_L030 | 0.85 | 1 |
| CH_U_R045 | CH_M_R030 | 0.85 | 1 |
| CH_U_L030 | CH_M_L030 | 0.85 | 1 |
| CH_U_R030 | CH_M_R030 | 0.85 | 1 |
| CH_U_L090 | CH_M_L030 | 0.85 | 2 |
| CH_U_R090 | CH_M_R030 | 0.85 | 2 |
| CH_U_L110 | CH_M_L110 | 0.85 | 2 |
| CH_U_L110 | CH_M_L030 | 0.85 | 2 |
| CH_U_R110 | CH_M_R110 | 0.85 | 2 |
| CH_U_R110 | CH_M_R030 | 0.85 | 2 |
| CH_U_L135 | CH_M_L110 | 0.85 | 2 |
| CH_U_L135 | CH_M_L030 | 0.85 | |
| CH_U_R135 | CH_M_R110 | 0.85 | |
| CH_U_R135 | CH_M_R030 | 0.85 | |
| CH_U_180 | CH_M_180 | 0.85 | |

wherein characters "CH" stand for "channel", character "M" stands for an elevation angle of 0° , character "U" stands for an elevation angle >0° , after one of the labels M/U is a label for left (L) or right (R) followed by the azimuth angle, Gain is a gain used in mapping of the respective input loudspeaker channel to the respective output loudspeaker channel, and EQ index indicates which equalizer is to be applied, with the following equalizer parameters for equalizers 1 and 2:

| Equalizer | $P_f$[Hz] | $P_Q$ | $P_g$[dB] | g [dB] |
|---|---|---|---|---|
| $G_{EQ,1}$ | 12000 | 0.3 | −2 | 1.0 |
| $G_{EQ,2}$ | 12000 | 0.3 | −3.5 | 1.0 |

wherein $G_{EQ,e}$ consists of gain values per frequency band k and equalizer index e, $P_f$ is the peak-frequency in Hz, $P_Q$ is a peak filter quality factor, $P_g$ is a gain in dB applied to the peak frequency, and g in dB is an overall gain applied to the peak filter, wherein equalizers $G_{EQ,1}$, $G_{EQ,2}$ include a single peak filter, wherein each equalizer is a serial cascade of one peak filter and a gain:

$$G_{EQ,e}^{k} = 10^{\frac{G}{20}} peak(band(k) \cdot f_s/2, P_f, P_Q, P_g)$$

where band(k) is the normalized center frequency of each frequency band, $f_s$ is the sampling frequency, and function peak()is $$peak(b, f, Q, G) = \sqrt{\frac{b^4 + \left(\frac{1}{Q^2} - 2\right) f^2 b^2 + f^4}{b^4 + \left(\frac{10^{\frac{-G}{10}}}{Q^2} - 2\right) f^2 b^2 + f^4}}$$

wherein b is given by band(k)·$f_s$/2, Q is given by $P_Q$ for the respective peak filter , G is given by $P_g$ for the respective peak filter, and f is given by $P_f$ for the respective peak filter, wherein each band k is specified by its normalized center frequency band(k) where 0<=band<=1, wherein the normalized frequency band=1 corresponds to the unnormalized frequency $f_s$/2, where $f_s$ denotes the sampling frequency, and band(k)·$f_s$/2 denotes the unnormalized center frequency of band k in Hz.

10. The method of claim 9, wherein the equalization filter boosts a spectral portion of the second input loudspeaker channel when compared to other spectral portions of the second input loudspeaker channel, wherein the spectral portion which is boosted gives the listener the impression that sound comes from a position corresponding to a position of the second input loudspeaker channel.

11. The method of claim 10, wherein a direction of the second input loudspeaker channel has an elevation angle larger than an elevation angle of the first output loudspeaker channel which the second input loudspeaker channel is mapped to, and wherein the spectral portion which is boosted is in a frequency range between 3 kHz and 7.5 kHz.

12. A non-transitory digital storage medium comprising, recorded thereon, a computer program for performing, when running on a computer or a processor, the method of claim 9.

13. The method of claim 9, wherein the equalization filter processes the second input loudspeaker channel in order to compensate for timbre differences caused by the different directions of the second input loudspeaker channel and the first output loudspeaker channel which the second input loudspeaker channel is mapped to.

14. The method of claim 9, comprising additionally applying a decorrelation filter to the second input loudspeaker channel, wherein the decorrelation filter introduces frequency dependent delays and/or randomized phases into the second input loudspeaker channel.

15. The method of claim 9, comprising additionally applying a decorrelation filter to the second input loudspeaker channel, wherein the decorrelation filter is a reverberation filter.

16. The method of claim 9, comprising additionally applying a decorrelation filter to the second input loudspeaker channel, wherein the decorrelation filter convolves the second input loudspeaker channel with an exponentially decaying noise sequence.

17. The method of claim 9, wherein coefficients of the equalization filter are set based on a measured binaural room impulse response of a specific listening room or are set based on empirical knowledge about room acoustics.

* * * * *